US011278756B2

(12) United States Patent
Lefkovitz

(10) Patent No.: US 11,278,756 B2
(45) Date of Patent: Mar. 22, 2022

(54) SYSTEM AND METHOD FOR BODILY SUPPORT

(71) Applicant: Jeffrey Thomas Lefkovitz, Los Angeles, CA (US)

(72) Inventor: Jeffrey Thomas Lefkovitz, Los Angeles, CA (US)

(73) Assignee: LEFKO-TEK LLC, Overland Park, KS (US)

( * ) Notice: Subject to any disclaimer, the term of this patent is extended or adjusted under 35 U.S.C. 154(b) by 182 days.

(21) Appl. No.: 16/791,877

(22) Filed: Feb. 14, 2020

(65) Prior Publication Data

US 2020/0206558 A1 Jul. 2, 2020

Related U.S. Application Data

(63) Continuation-in-part of application No. 15/451,049, filed on Mar. 6, 2017, now abandoned.
(Continued)

(51) Int. Cl.

| | |
|---|---|
| ***A63B 21/068*** | (2006.01) |
| ***A63B 21/00*** | (2006.01) |
| ***A61H 3/04*** | (2006.01) |
| ***A63B 69/00*** | (2006.01) |
| *A63B 24/00* | (2006.01) |
| *A63B 22/02* | (2006.01) |

(52) U.S. Cl.

CPC ..... *A63B 21/068* (2013.01); *A61H 3/04* (2013.01); *A63B 21/00181* (2013.01); *A63B 21/4039* (2015.10); *A63B 69/0064* (2013.01); *A61H 2201/1633* (2013.01); *A63B 21/158* (2013.01); *A63B 22/02* (2013.01); *A63B 24/0087* (2013.01); *A63B 2208/0204* (2013.01); *A63B 2208/0228* (2013.01); *A63B 2210/50* (2013.01); *A63B 2225/09* (2013.01)

(58) Field of Classification Search

CPC ..... A63B 21/068; A63B 21/00181; A63B 21/4039; A63B 69/0064; A63B 2210/50; A63B 2208/0204; A63B 24/0087; A63B 21/158; A63B 2208/0228; A63B 22/02; A63B 2225/09; A61H 3/04; A61H 2201/1633

See application file for complete search history.

(56) References Cited

U.S. PATENT DOCUMENTS 2,327,671 A * 8/1943 Rupprecht ..... A61H 3/04 280/87.021
2,544,106 A * 3/1951 Ray ..... A63G 11/00 472/110

(Continued)

*Primary Examiner* — Andrew S Lo
(74) *Attorney, Agent, or Firm* — Cohen IP Law Group, PC; Michael N. Cohen

(57) ABSTRACT

An exercise support system configured to support at least a portion of a user's weight is disclosed. The exercise support system may include a base assembly including a plurality of frame members defining an interior region of the system. The system may also include a lift assembly comprising a drive assembly and an arm assembly. A body support (e.g., a seat) may be configured with the arm assembly. In general, the base assembly provides support to the lift assembly, and the lift assembly provides the mechanism(s) and forces to raise and lower the arm assembly (and the body support) thereby supporting at least a portion of the user's weight.

15 Claims, 24 Drawing Sheets

Related U.S. Application Data

(60) Provisional application No. 62/304,031, filed on Mar. 4, 2016.

(56) References Cited

U.S. PATENT DOCUMENTS 3,252,704 A * 5/1966 Callie ..... A61G 7/1017 482/68
3,374,493 A * 3/1968 Herrara ..... A61G 7/1074 5/86.1
3,599,962 A * 8/1971 Henry ..... A61F 15/005 269/182
4,187,869 A * 2/1980 Marchetti ..... A61H 3/04 135/67
4,211,426 A * 7/1980 Motloch ..... A47D 13/04 280/87.041
4,793,608 A * 12/1988 Mahnke ..... A63B 21/154 482/138
5,058,887 A * 10/1991 Patterson ..... A63B 21/154 482/113
5,178,599 A * 1/1993 Scott ..... A63B 23/00 472/110
5,502,851 A * 4/1996 Costello ..... A61H 3/04 482/69
6,224,154 B1 * 5/2001 Stoki ..... A61B 90/60 297/338
6,619,735 B1 * 9/2003 Ming-Hwa ..... A47C 3/30 297/170
6,666,798 B2 * 12/2003 Borsheim ..... A61H 3/00 434/247
6,733,018 B2 * 5/2004 Razon ..... A61H 3/008 135/67
6,821,233 B1 * 11/2004 Colombo ..... A61F 5/0102 482/54
6,872,145 B1 * 3/2005 Boudreaux ..... A63G 11/00 472/110
7,275,554 B2 * 10/2007 Mullholand ..... A61H 3/008 135/67
7,568,712 B2 * 8/2009 Kovachi ..... A61H 3/008 280/23.1
7,572,190 B2 * 8/2009 Habing ..... A63G 11/00 472/110
8,033,921 B2 * 10/2011 Habing ..... A63G 13/08 472/110
8,100,776 B2 * 1/2012 Habing ..... A63G 11/00 472/110
8,122,534 B2 * 2/2012 Biersteker ..... A61G 7/1061 5/86.1
8,151,812 B2 * 4/2012 Razon ..... A61H 3/04 135/66
9,498,696 B1 * 11/2016 Razon ..... A63B 71/0009
2012/0000496 A1 * 1/2012 Razon ..... A61H 3/04 135/67

* cited by examiner

SYSTEM AND METHOD FOR BODILY SUPPORT

CROSS REFERENCE TO RELATED APPLICATIONS

This application is a continuation-in-part of U.S. patent application Ser. No. 15/451,049 filed Mar. 3, 2017, the contents of which are fully incorporated herein by reference for all purposes.

COPYRIGHT STATEMENT

This patent document contains material subject to copyright protection. The copyright owner has no objection to the reproduction of this patent document or any related materials in the files of the United States Patent and Trademark Office, but otherwise reserves all copyrights whatsoever.

FIELD OF THE INVENTION

This invention relates to support equipment, including equipment that supports a person's body while exercising.

BACKGROUND OF THE INVENTION

Supportive exercise systems can be used to provide mechanical support to assist a user with physical limitations, particularly walking and standing limitations, when performing many different kinds of exercises. The mechanical support component of such a device can protect the user from falling and enable the user to use various types of exercise equipment. These supportive exercise systems are commonly configured with partial weight bearing components that can assist a patient during training, where the weight of the user is all or partially supported by the system. The weight bearing components are also commonly adjustable so that the amount of weight relief provided to the user can be gradually reduced as the user regains strength and recovers from his or her physical limitations. These supportive exercise systems or devices are also commonly used by hospitals, nursing homes, physical therapy clinics, rehabilitation facilities and outpatient centers to provide weight relief to patients having walking disorders and require retraining.

Supportive exercise systems currently known in the art generally require the use of a hoist by either a cable suspended from the ceiling or a cable suspended from an upper portion of the device. The cable has a harness attached to one end that is placed around the patient for support. The hoist can then be adjusted for the appropriate weight support desired by the user.

However, these commonly known supportive exercise systems have several limitations that inhibit the user's/patient's ability to use the systems effectively. For example, such systems are typically not wheelchair accessible, do not allow for ambulatory functions, require assistance from another person, such as a trainer, to enter and use the system, place stress on the user's body due to the harness, and are not efficient at allowing the user to effectively regain strength due to the lifting forces of the weight bearing relief components of the system.

Accordingly, a need exists for a supportive exercise system capable of easily and effectively allowing a user with physical limitations to regain strength and mobility. A need also exists for such a system that is wheelchair friendly, allows for use while standing, walking and sitting, and does not require suspension lifting forces for weight bearing relief the inhibit effectiveness and place unnecessary stress on the user.

SUMMARY OF THE INVENTION

The present invention is directed generally to a supportive exercise system configured to provide body weight support or relief to a user of the system while exercising in either a standing or sitting exercising position. The system can be used to assist the user when performing exercises, either independently, such as natural walking, or through the use of other exercise equipment, such as a treadmill. The system can include wheels to allow the system to be easily transported across a floor or other surface and to be moved for use with other exercise or training equipment. The system can include brakes, clamps or other similar components for allowing the system to maintain a fixed position. The system can include attachment components that allow the system to connected, attached or otherwise secured to other exercise or training equipment, such as a treadmill.

The system can include a frame portion and a weight supporting portion connected to the frame portion. The frame portion can be configured with one or more frame members that define a frame perimeter. According to an exemplary embodiment, the frame portion includes two spaced apart longitudinal frame members and a transverse frame member extending between the longitudinal members to form a rectangular frame with one open end.

The weight supporting portion can be mounted or connected to the frame portion. The weight supporting portion can include a lever arm positioned above the frame portion of the system and lifting means for controlling the movement of the lever arm. The lifting means can be configured as any suitable type of lifting mechanism for controlling the movement of the lever arm, including but not limited to: a winch, an actuator, a screw lift, a pneumatic cylinder actuator, an electromechanical actuator or other mechanism capable of allowing and restricting movement of the lever arm.

According to an exemplary embodiment of the present invention, the weight supporting portion can include a support structure that can include a crossbar member extending between the frame and support columns extending upward from the crossbar member. The weight supporting portion can further include a rotatable lever arm positioned between the support columns and coupled to the columns by a pivot or pin connection. The lever arm can be configured to rotate about an axis perpendicular to the support columns. The lever arm can include a first end centrally located above the frame perimeter that has a seat connected thereto and a second opposing end connected to a lifting mechanism. According to one exemplary embodiment, the lifting mechanism can be configured as an actuator that includes a lower portion connected to the frame portion and an extension arm portion connected to the second end of the lever arm. The system can include a lifting mechanism control and operating system and a system control device configured to operate the lifting mechanism and allow a user to control the system.

According to an exemplary embodiments of the present invention, the weight supporting portion includes a carriage and rail assembly.

According to certain embodiments of the present invention, the system can include side supports configured as handrails positioned along the sides of the system in order to assist a user of the system.

According to certain embodiments of the present invention, the system can include leg supports configured for preventing a user's legs from moving too far forward and into the mechanical components of the system when the user is positioned on the seat of the system.

According to certain embodiments of the present invention, the system can include a front support component configured with handles and a chest protection pad to prevent the user's torso from moving too far forward and into the mechanical components of the system when the user is positioned on the seat of the system.

The system can operate by restricting the downward movement of the seat based on a desired body weight support amount selected by the user. The lifting mechanism can be configured to control the downward movement of the seat by restricting rotation of the lever arm. The lifting mechanism can be connected to the second end of the lever arm and prevent upward movement of the second end of the lever arm (thereby preventing the downward movement of the first end of the lever arm and the seat connected thereto) unless a downward force is applied to the seat by the user that is greater than the selected body weight support amount. The system can include a control device that can be configured to allow the user to variably select the body weight support amount provided by the lifting mechanism.

According to an exemplary embodiment of the present invention, the lifting mechanism can be configured as an actuator that can restrict extension of the extension arm connected to the second end of the lever arm, which can then prevent the upward movement of the second end of the lever arm, and thus the downward movement of the seat end of the lever arm. A user can use the system by using the control device to select a desired amount of body weight support. The control device, in conjunction with the lifting mechanism operating system, can then adjust the body weight support force provided by the lifting mechanism to an amount that prevents downward movement of the seat end of the lever arm unless the user applies more body weight than the selected body weight support amount force. The user can then position himself or herself onto the seat end of the lever arm and begin exercising.

According to an exemplary embodiment of the present invention, the lifting mechanism includes a lifting column assembly.

According to an exemplary embodiment of the present invention, the lifting mechanism includes a pulley lift assembly.

According to an exemplary embodiment of the present invention, the lifting mechanism includes a mast assembly.

According to an exemplary embodiment of the present invention, the lifting mechanism includes a scissor lift assembly.

Other aspects and advantages of the present invention will be apparent from the following detailed description of the preferred embodiments and the accompanying drawings figures.

BRIEF DESCRIPTIONS OF THE DRAWINGS

In the accompanying drawing, which forms a part of the specification and is to be read in conjunction therewith in which like reference numerals are used to indicate like or similar parts in the various views:

FIG. 16 shows a front view of a lift column in an extend position and in a retracted position according to exemplary embodiments herein;

DETAILED DESCRIPTION OF THE PREFERRED EMBODIMENTS

Figure 1:
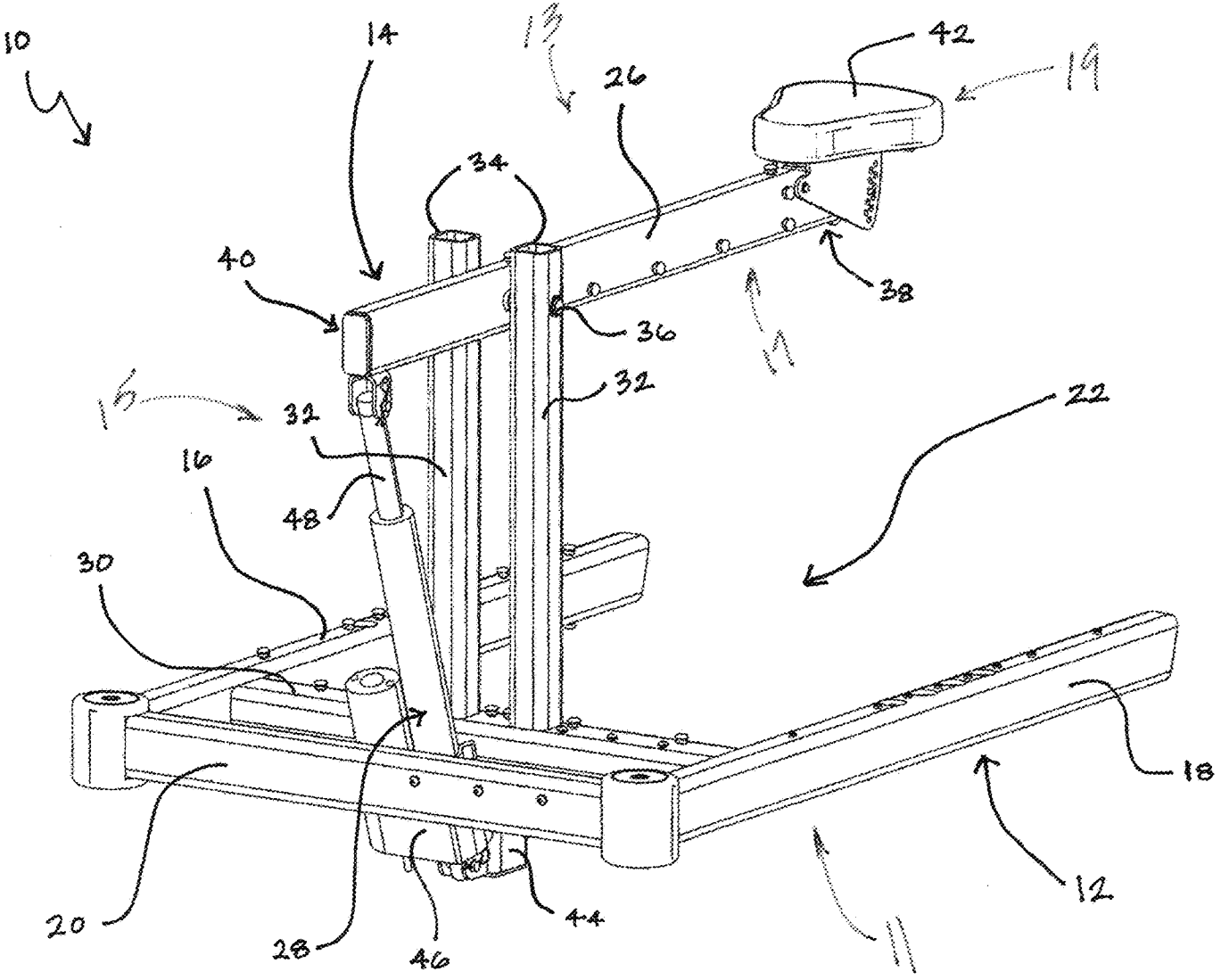
FIG. 1 is a perspective view of a supportive exercise system with a frame portion and a weight supporting portion in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

Referring to the figures, the present invention is directed generally to a supportive exercise system 10 that can be used by a patient or user with physical impairments when exercising. In some embodiments, the system 10 may provide supportive weight relief to the user while performing exercises in either a standing or sitting position by reducing the amount of body weight the user must support with his or her legs as described in greater detail herein. In other embodiments, the system 10 may be configured to provide supportive weight relief to the user as the user prepares for a particular exercise. For example, the system 10 may provide supportive weight relief to the user as the user is fitted with walking braces in preparation for assisted walking exercises. In some embodiments, some elements of the system 10 (e.g., the side support rails) may remain in place during the exercises as required. In some embodiments, some elements of the system 10 may be move away during the exercises. For example, once a patient is fitted with walking braces and is prepared to perform assisted walking exercises, the seat may be moved away as supportive weight relief may not be required during the exercises.

The system 10 may be configured for assistance during ambulatory exercises, such as natural walking or walking on a treadmill, and/or for assistance during seated exercises. The system 10 may be configured to be used as a standalone device or in connection with other exercising or training equipment, such as a treadmill. The system 10 may include connecting components that may allow the system 10 to be secured to other exercising or training equipment. The system 10 may further be configured for wheelchair accessibility in certain embodiments of the present invention.

Figure 1A:
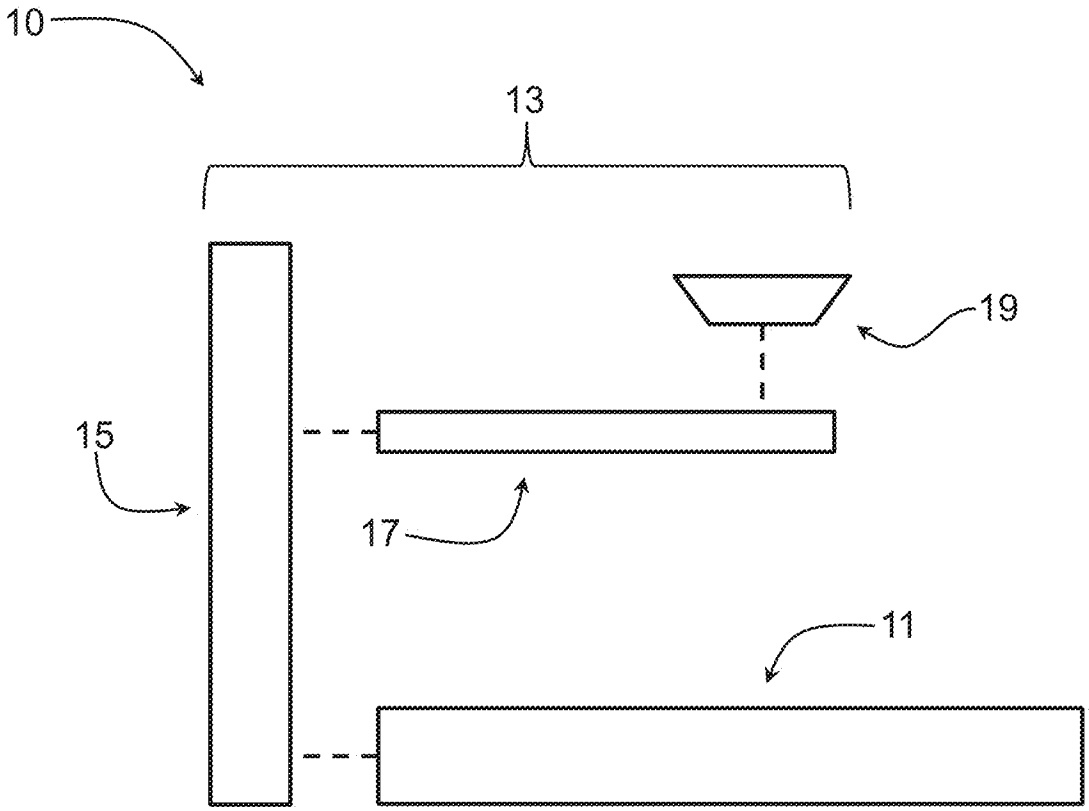
FIG. 1A shows a schematic of an exercise support system according to exemplary embodiments herein.

In some embodiments as shown in FIG. 1A, exemplary embodiments hereof provide a system 10 that may include a base assembly 11 and a lift assembly 13. The lift assembly 13 may include a drive assembly 15 and an arm assembly 17. A body support 19 (e.g., a seat) may be configured with the lift assembly 13. In one preferred implementation, the body support 19 may be configured with the arm assembly 17 as shown. In general, the base assembly 11 provides support to the lift assembly 13, and the lift assembly 13 provides the mechanism(s) and force to raise and lower the arm assembly 17 (and the body support 19).

The configurations between the base assembly 11, the lift assembly 13, the drive assembly 15, the arm assembly 17 and the body support 19 are designated in FIG. 1A as dashed lines to represent that the elements 11, 13, 15, 17, 19 may be configured and operated in a number of ways, all of which are within the scope of the system 10. The elements, configurations, architecture, functionalities and operational methodologies of the system 10 and its elements (e.g., elements 11, 13, 15, 17 and 19) will be described by way of several detailed exemplary embodiments hereof.

Turning to FIGS. 1-6, in one exemplary embodiment hereof, the base assembly 11 may include a frame portion 12, and the lift assembly 13 may include a weight supporting portion 14. Weight supporting portion 14 can be configured to provide full or partial body weight support to the user when in an exercising or pre-exercising position (either standing or sitting) by fully or partially reducing the amount of body weight the user must support on his or her own. Frame portion 12 can be configured to house and secure weight supporting portion 14 in order to allow system 10 to provide the body weight support to the user.

As best shown in FIG. 1, frame portion 12 can include first and second longitudinal frame members 16 and 18 arranged in a spaced-apart configuration and defining the sides of frame portion 12 and system 10. According to the exemplary embodiment illustrated in the FIGS. 1-6, first and second longitudinal frame members 16 and 18 can have a generally horizontal orientation and can extend generally parallel to one another in the longitudinal direction. As best shown in FIG. 1, frame portion 12 can further include a first transverse frame member 20 extending transversely between first and second longitudinal frame members 16 and 18 at one end of frame portion 12. Transverse frame member 20 can be connected to longitudinal frame members 16 and 18 using any suitable type of connection. As shown in FIGS. 1-6, first and second longitudinal frame members 16 and 18 and transverse frame member 20 can collectively create a partially enclosed frame perimeter with an opening at the end opposite transverse frame member 20 to allow access to an interior region 22 of system 10. The interior region 22 of system 10 can represent the area between and above frame portion 12 where the user of system 10 can stand or sit while utilizing the weight support relief provided by weight supporting portion 14.

As illustrated in FIGS. 1-6, frame portion 12 can be configured with a generally orthogonal frame perimeter where first and second longitudinal frame members 16 and 18 are generally parallel to one another and transverse frame member 20 is generally perpendicular to first and second frame members 16 and 18. Such an arrangement can provide system 10 with an interior region 22 having sufficient space to allow the user to easily enter and use system 10. Such an arrangement can also allow system 10 to be wheelchair accessible. However, it is recognized that frame portion 12 can have any number of suitable configurations where frame members 16, 18 and 20 are arranged in a non-horizontal or non-orthogonal manner in various embodiments of the present invention.

As shown in FIGS. 2-6, frame portion 12 can additionally include one or more wheels 24 connected to frame members 16, 18 and/or 20 in order to allow for easy movement and transport of system 10. According to an exemplary embodiment, frame portion 12 can include brakes, clamps or similar components to allow system 10 to be secured in a fixed position. According to an exemplary embodiment, frame portion 12 can include connection components that allow system 10 to be fixed or otherwise secured to other equipment and objects.

Figure 2:
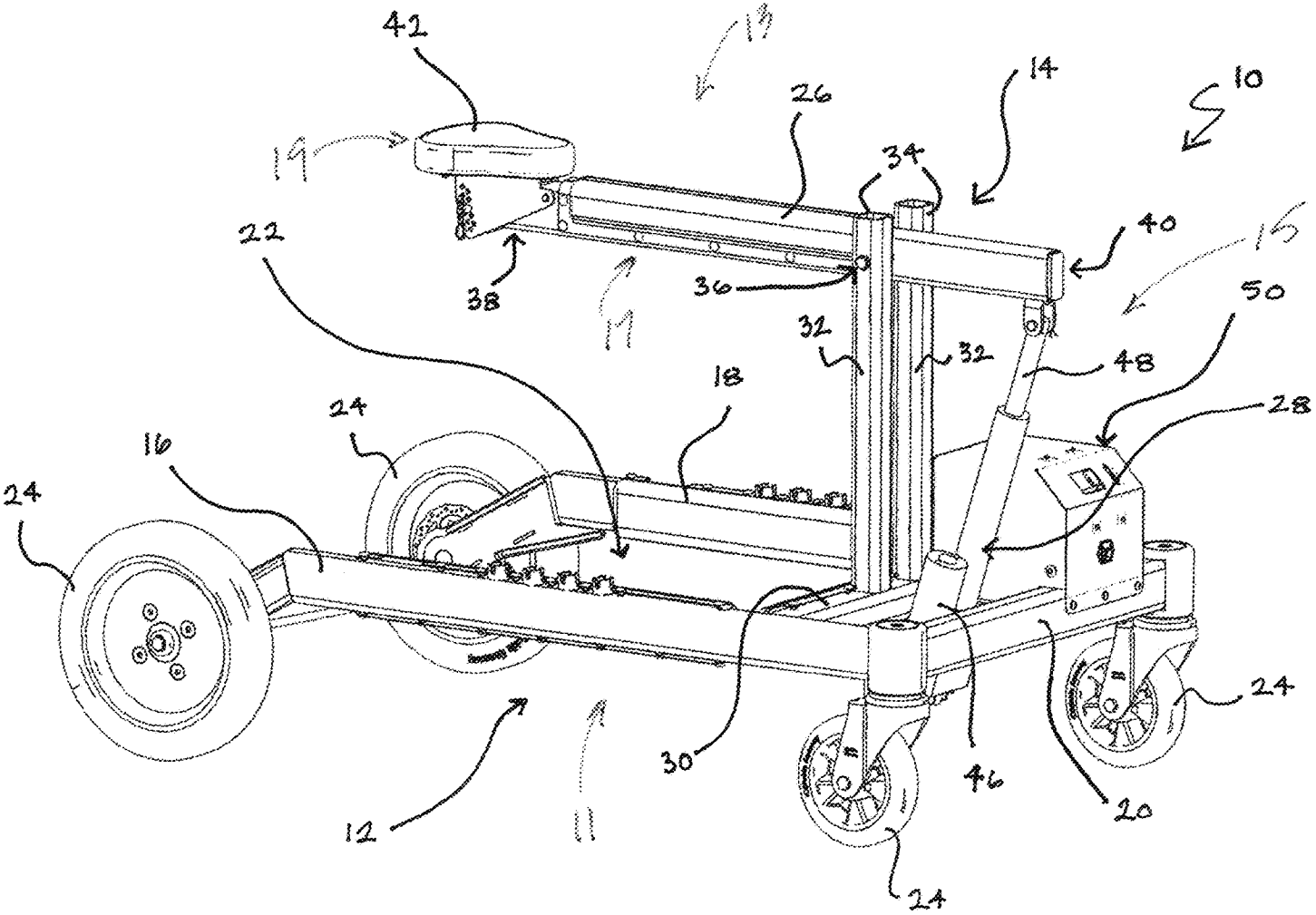
FIG. 2 is a perspective view of a supportive exercise system in accordance with one embodiment of the present invention.
Figure 3:
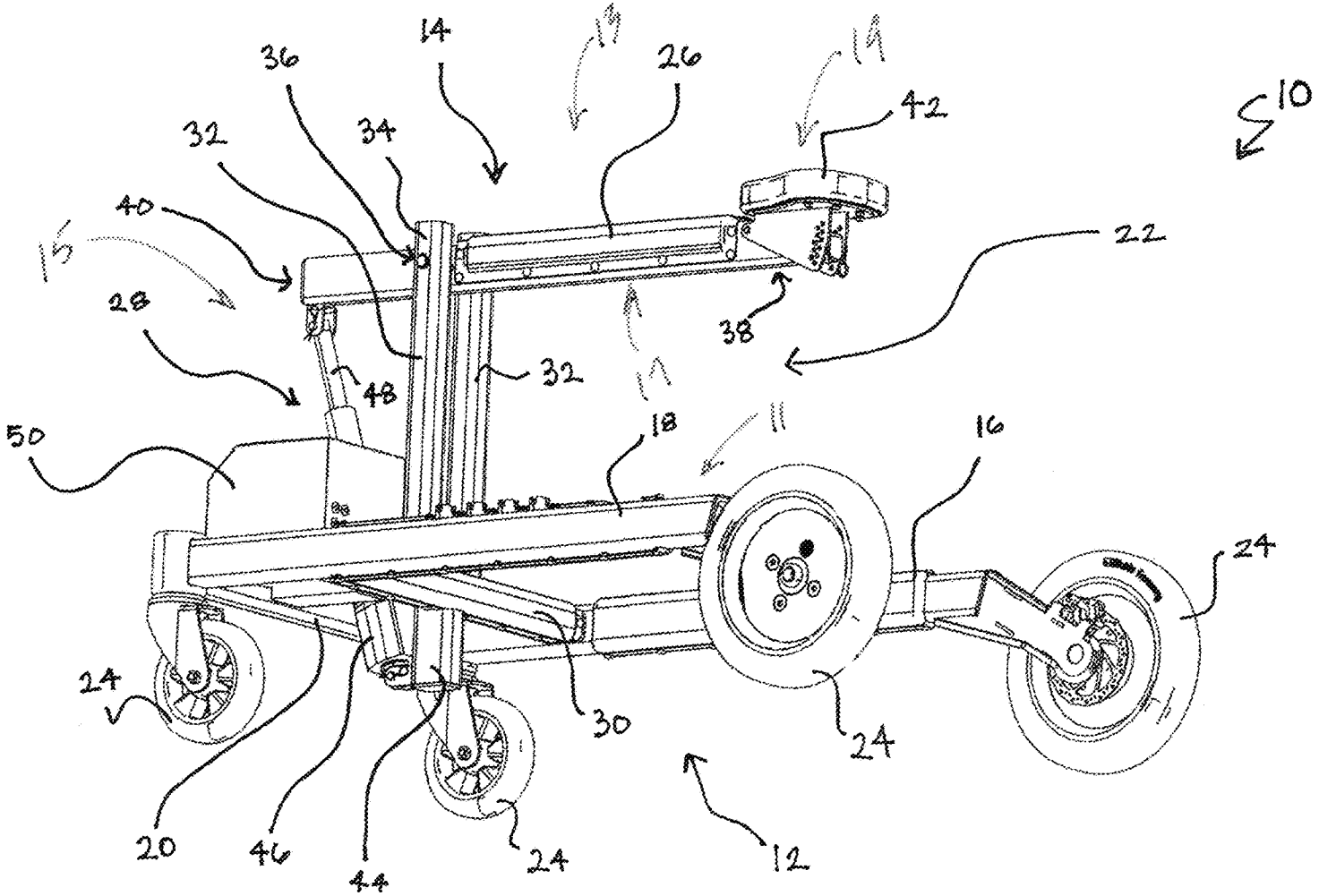
FIG. 3 is a bottom perspective view of the supportive exercise system of FIG. 2.

As best shown in FIG. 1, weight supporting portion 14 can be mounted onto frame portion 12 by a support structure (described below) and can include a rotating lever arm 26 and a lifting mechanism 28 in order to provide the weight support functionality of system 10. According to various exemplary embodiments of the present invention, lifting mechanism 28 can be configured as an actuator, screw lift, winch, mechanical lift, pneumatic lift, hydraulic lift or other lifting device. The support structure for mounting lever arm 26 to frame portion 12 can include a crossbar member 30 extending across frame portion 12 and one or more support columns 32 extending upward from crossbar member 30. As best shown in FIGS. 1 and 2, crossbar member 30 can be located within the frame perimeter and can extend between and be connected to first and second longitudinal frame members 16 and 18. According to an exemplary embodiment, crossbar member 30 can be positioned adjacent to, but spaced part from, transverse frame member 20 near the front end of frame portion 12 and interior region 22. In certain embodiments of the present invention (not shown), transverse frame member 20 can also function as crossbar member 30.

Support columns 32 can be connected to crossbar member 30 at an intermediate and/or central location of crossbar member 30 using any suitable type of fixed connection. As shown in FIGS. 1-6, support columns 32 can extend upward from crossbar member 30, and each support column 32 can terminate at an upper end 34. As also shown in FIGS. 1-6, support columns 32 can be slightly spaced apart from one another across the length of crossbar member 30 to allow lever arm 26 to pass between the two columns 32.

Figure 4:
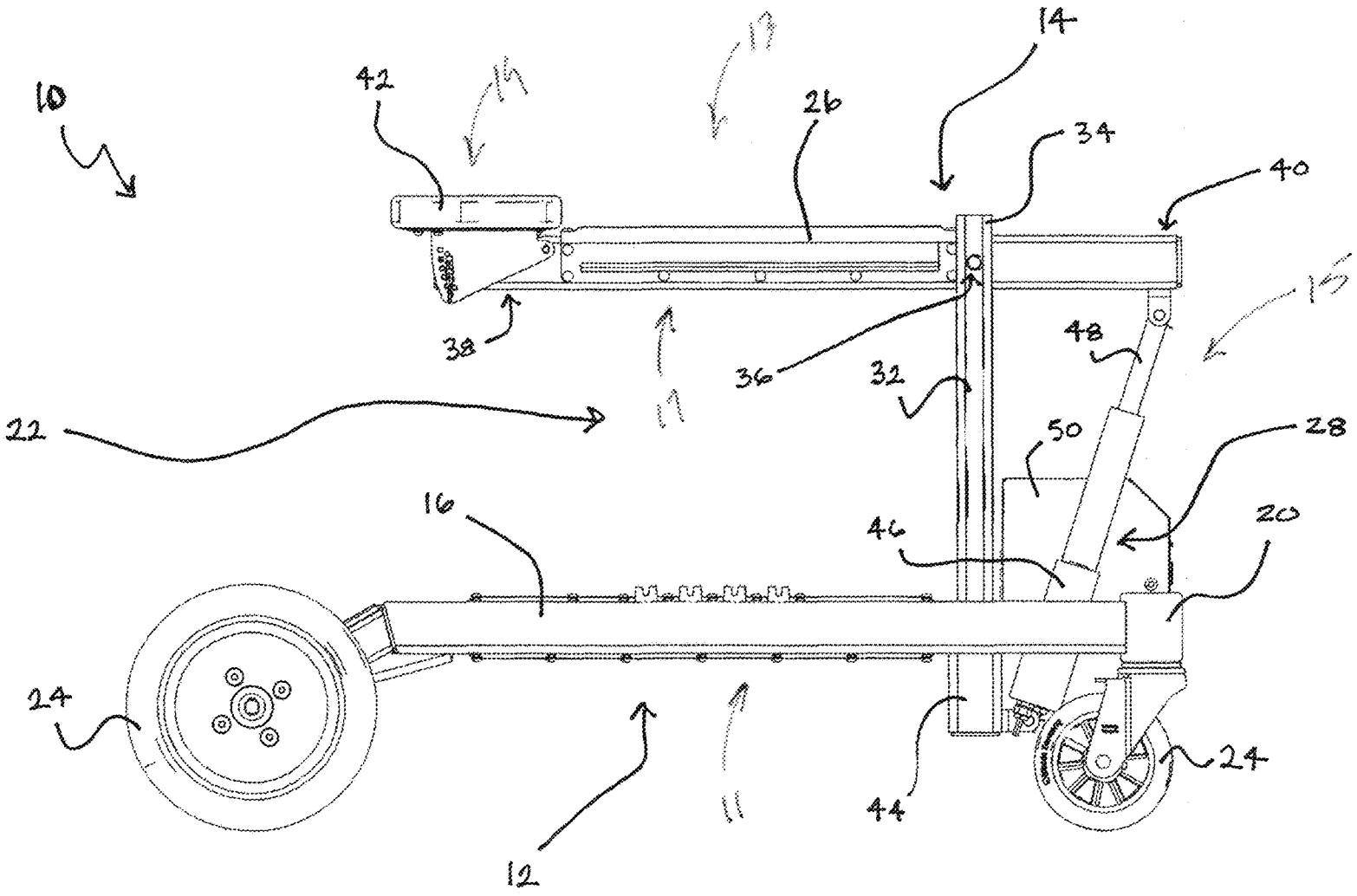
FIG. 4 is a side elevation view of the supportive exercise system of FIG. 2.
Figure 5:
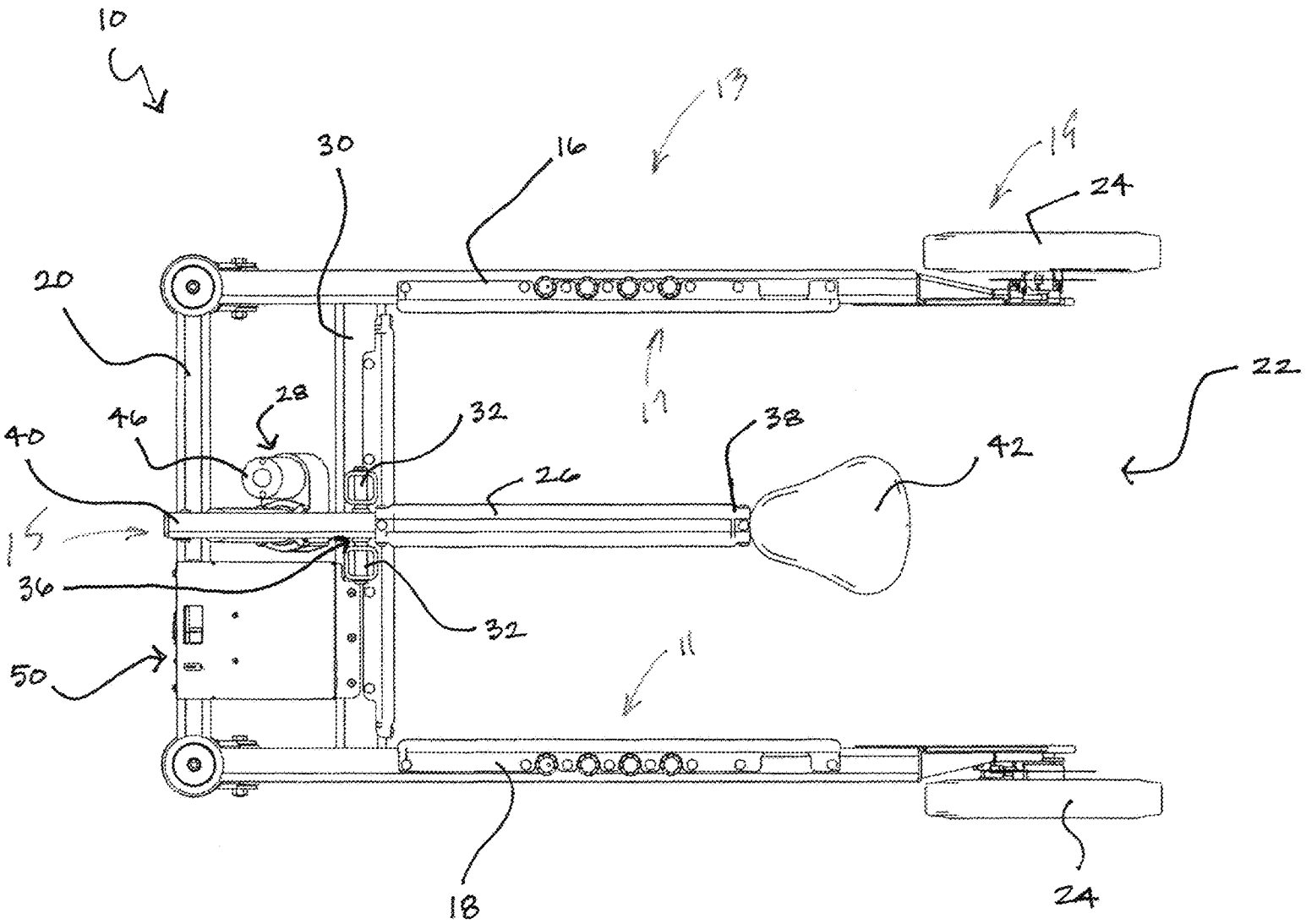
FIG. 5 is a top plan view of the supportive exercise system of FIG. 2.
Figure 6:
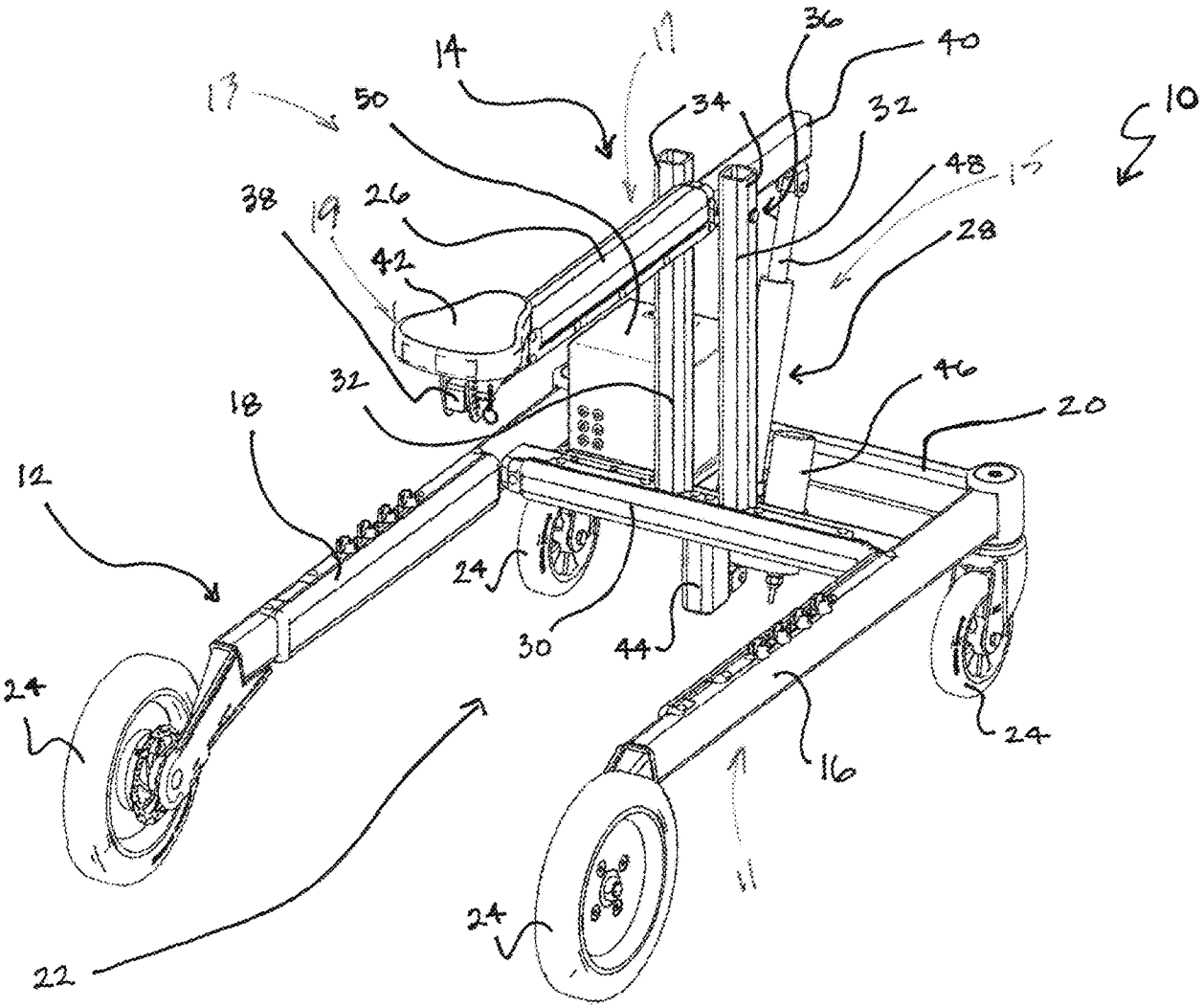
FIG. 6 is a rear perspective view the supportive exercise system of FIG. 2.

Lever arm 26 can be connected to support columns 32 near upper ends 34 by a pivot connection 36, such as a pin connection, that extends through both support columns 32 and lever arm 26. As best shown in FIG. 6, lever arm 26 can and can extend between both support columns 32 in the longitudinal direction and generally perpendicular to the orientation of support columns 32. As best shown in FIG. 4, pivot connection 36 can be located at an intermediate position along the length of lever arm 26 and can allow lever arm 26 to rotate about an axis that is generally perpendicular to support column 32. As further shown in FIG. 4 as well as FIG. 5, lever arm 26 can be positioned relative to frame portion 12 such that the length of lever arm 26 is generally located above frame portion 12 and at least partially within interior region 22 of system 10.

As best shown in FIG. 2, lever arm 26 can include a first end 38 and a second end 40. First end 38 can be located within a central part of interior region 22 and above frame portion 12 when lever arm 26 is extending in a generally horizontal direction. A seat 42 can be connected to first end 38 and can be configured for allowing a user of system 10 to place all or a portion of the user's body weight on seat 42 in either a sitting or standing position. According to an exemplary embodiment of the present invention, as illustrated in the FIGS. 1-6, seat 42 can be connected to first end 38 by a hinged connection that can allow seat 42 to pivot relative to lever arm 26 so that seat 42 can remain generally horizontal when lever arm 26 rotates about its pivot axis. Seat 42 can additionally have an adjustment component for allowing a user of system to selectively adjust the orientation of seat 42 relative to lever arm 26.

As shown in FIGS. 1-6, lifting mechanism 28 can be mounted to frame portion 12 below lever arm 26 by means of crossbar member 30 and/or transverse frame member 20. Lifting mechanism 28 can be configured as any suitable type of device that can control the movement of lever arm 26, including but not limited to: an actuator, a winch, a screw lift, a pneumatic lift or cylinder, a mechanical lift, a hydraulic lift or similar type of lifting device. Lifting mechanism 28 can include one portion connected to frame portion 12 and another portion connected to second end 40 of lever arm 26. According to one exemplary embodiment, lifting mechanism 28 includes a lower base portion 46 connected to frame portion 12 and an extendable rod or arm 48 connected to base portion 46 and extendable therefrom. Lifting mechanism 28 can be configured to control the elevation of seat 42 by restricting the rotation of lever arm 26. By restricting the rotation of lever arm 26, and thus the elevation of seat 42, lifting mechanism 28 can generate body weight support or weight bearing relief for a user positioned on seat 42.

According to an exemplary embodiment, as best illustrated in FIG. 1, lifting mechanism 28 can operate by controlling the upward and downward movement of second end 40 of lever arm 26. When second end 40 of lever arm 26 moves downward, seat 42 connected to first end 38 of lever arm 26 can move upward. When second end 40 of lever arm 26 moves upward, seat 42 connected to first end 38 of lever arm 26 can move downward. Lifting mechanism 28 can be configured to prevent upward movement of second end 40 of lever arm 26 (and thus downward movement of seat 42) in order to provide full or partial body weight support or relief to a user positioned on seat 42. Lifting mechanism 28 can be configured to provide a selected body weight support force to lever arm 26 (via second end 40) that can prevent any upward movement of second end 40 of lever arm 26 (and thus downward movement of seat 42 connected to first end 38 of lever arm 26) unless a downward force applied to seat 42 (e.g., the amount of the user's body weight applied to seat 42 when the user is using system 10) is greater than the selected body weight support force amount. The body weight support force can be the amount of force provided by lifting mechanism 28 to lever arm 26 to prevent movement of seat 42 (via movement of lever arm 26) to support the body weight support or relief amount selected by the user of system 10. As a result, lifting mechanism 28 holds second end 40 of lever arm 26 (and thus seat 42) in a stationary position when the downward (body weight) force applied by the user to seat 42 is less than the body weight support force amount provided by lifting mechanism 28. Lifting mechanism 28 can include a lifting control and operating system 50 (which can include components such as an electric motor, servo or other motor, a battery, a drive crank, a compressor, etc.) that can mounted to frame portion 12 and configured to allow lifting mechanism 28 to provide the body weight support force amount to lever arm 26.

According to one embodiment of the present invention, weight supporting portion 14 and lifting mechanism 28 can further be configured to allow the user of system 10 to adjust the elevation of seat 42. Lifting mechanism 28 can be configured to selectively move second end 40 of lever arm 26 in an upward direction an extension length in order to move seat 42 (via first end 38 of lever arm 26) downward to a desired elevation. Similarly, lifting mechanism 28 can be configured to selectively move second end 40 of lever arm 26 in a downward direction a retraction length in order to move seat 42 (via first end 38 of lever arm 26) upward to a desired elevation. According to an exemplary embodiment, lifting mechanism 28, via control system 50, can control the extension and retraction of extension arm 48 relative to lower base portion 46 in order to move second end 40 of lever arm 26 in an upward or downward direction to control the elevation of seat 42. Such a configuration can allow the user of system 10 to selectively adjust the elevation of seat 42 to his or her preference.

Figure 8:
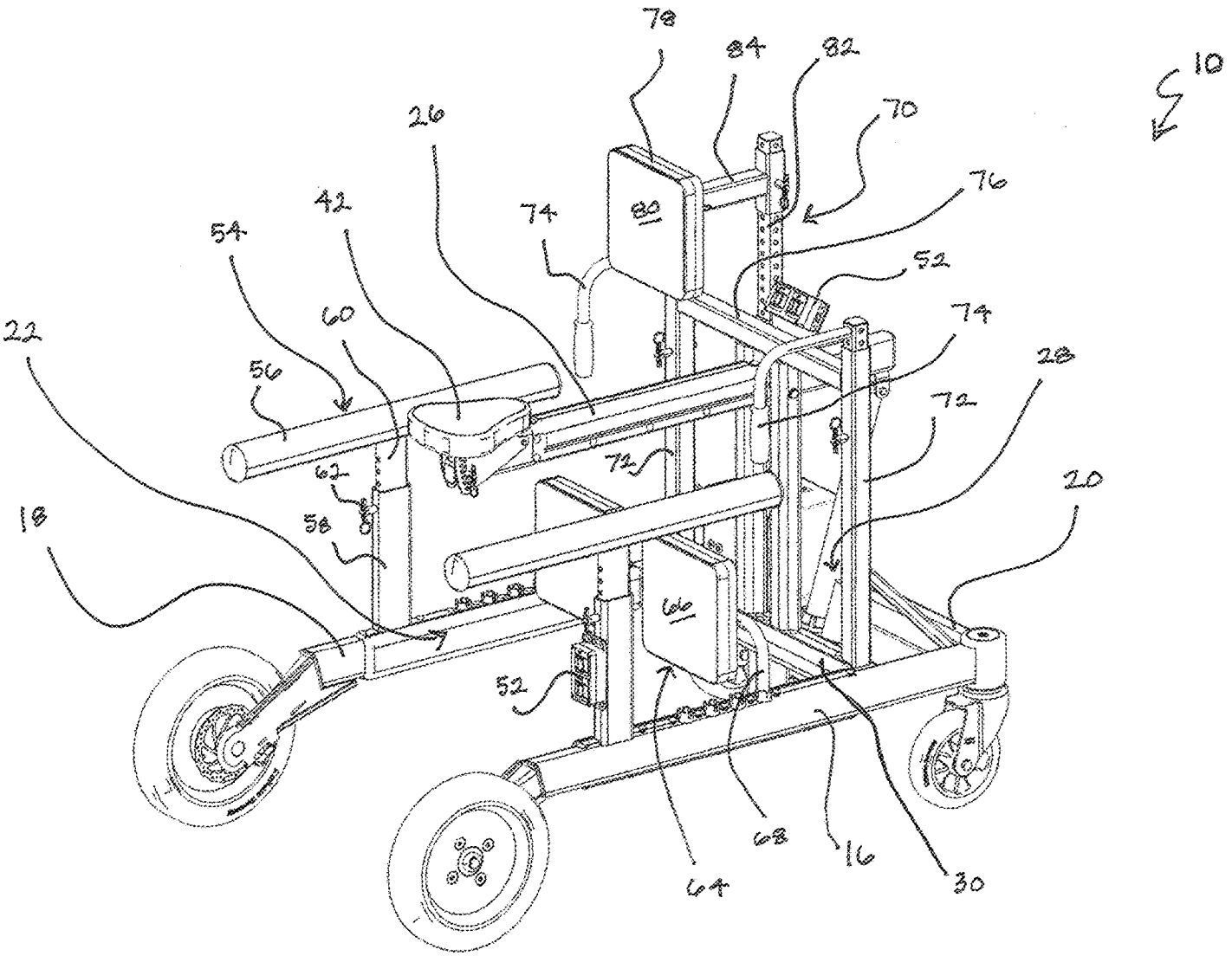
FIG. 8 is a rear perspective view of a supportive exercise system in accordance with another embodiment of the present invention.
Figure 12:
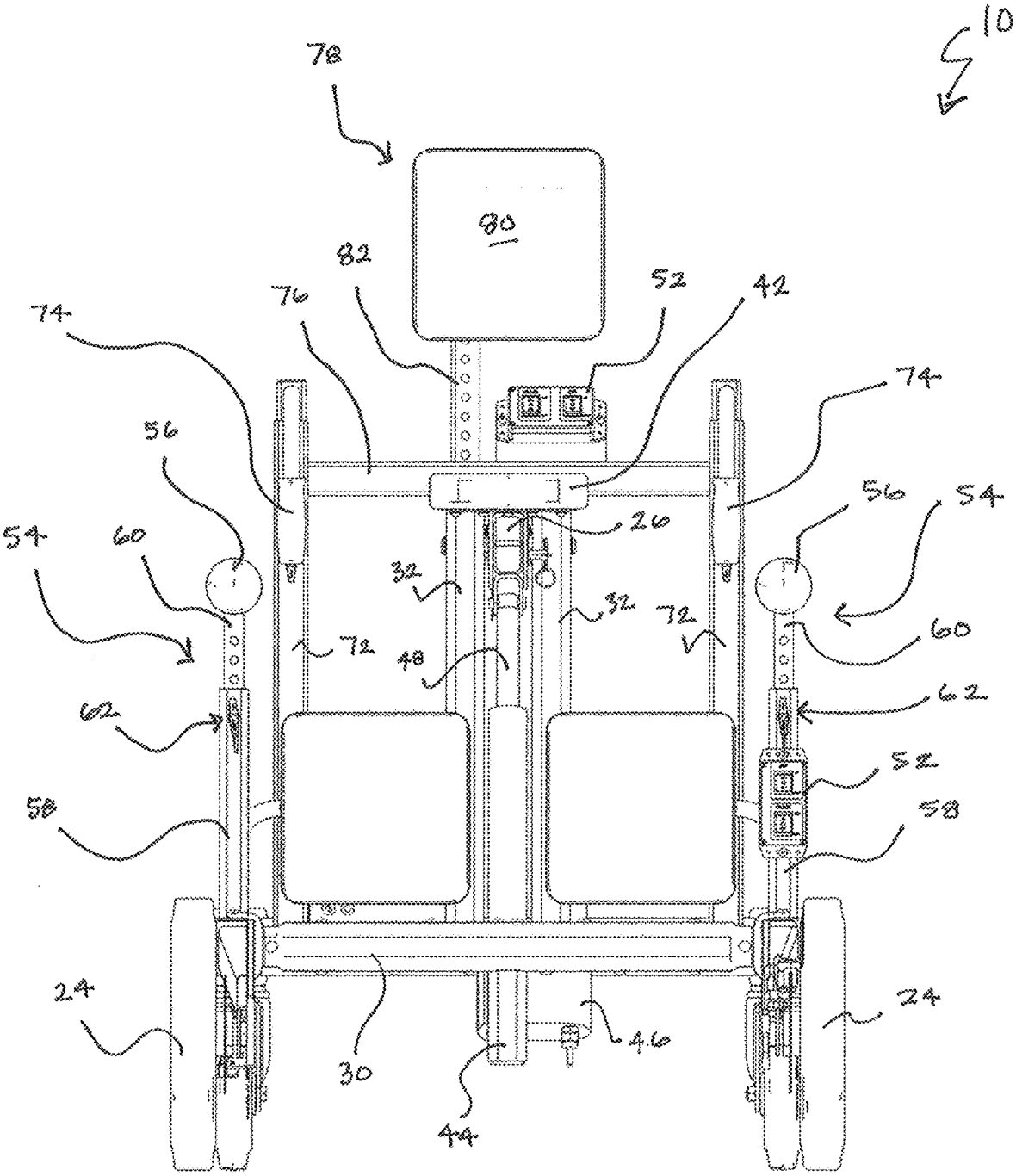
FIG. 12 is a rear elevation view of the supportive exercise system of FIG. 8.
Figure 13:
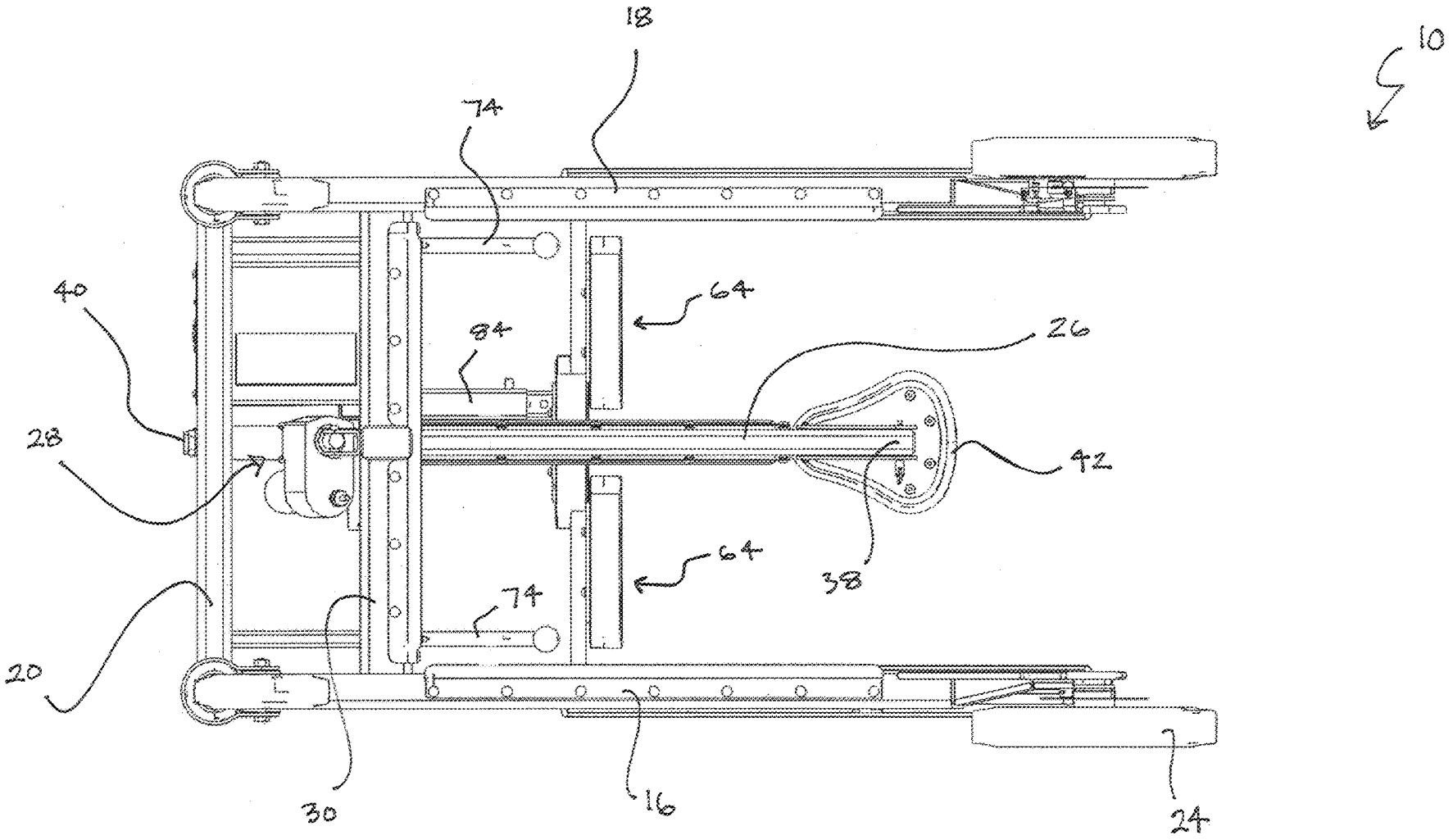
FIG. 13 is a bottom plan view of the supportive exercise system of FIG. 8.
Figure 14:
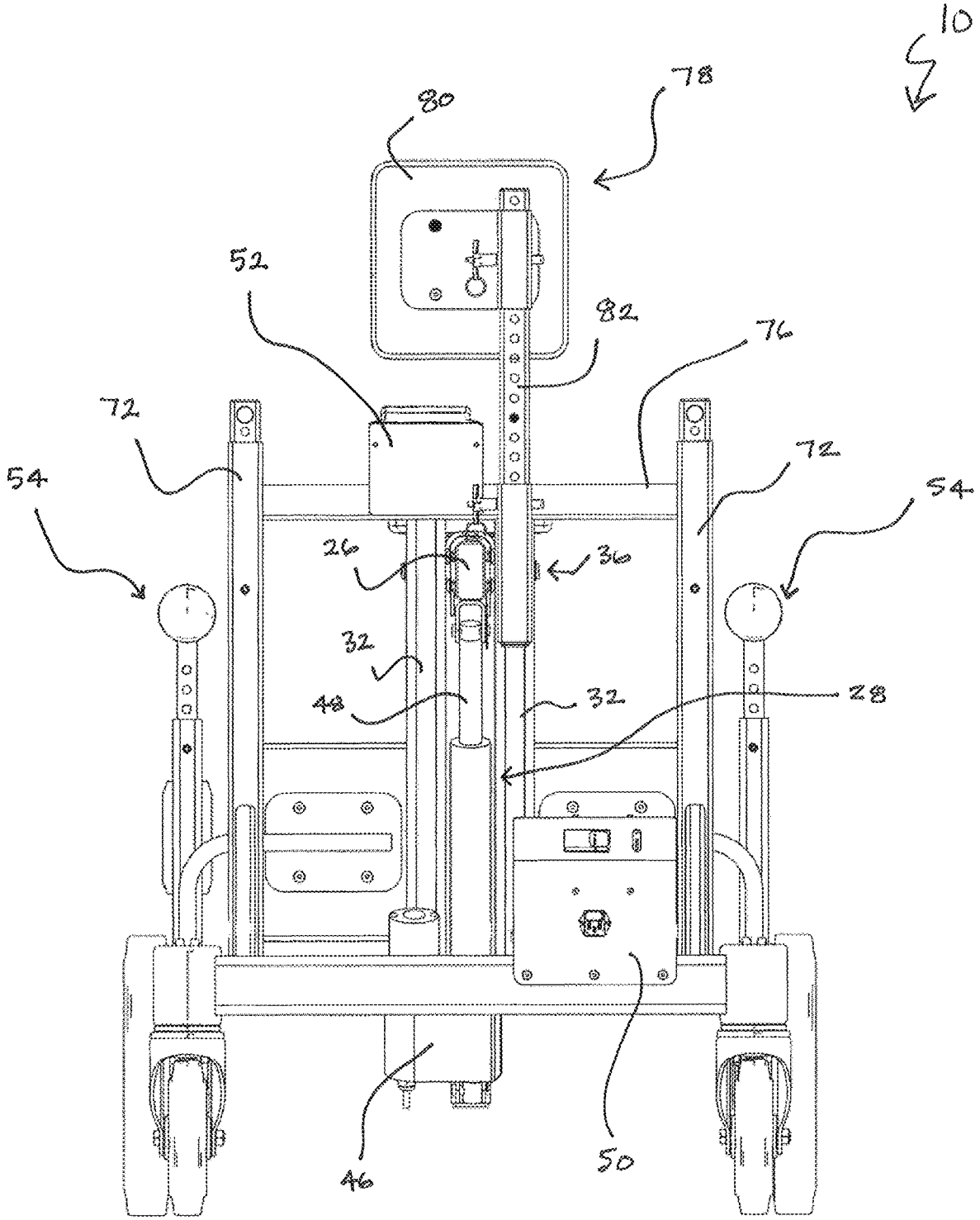
FIG. 14 is a front elevation view of the supportive exercise system of FIG. 8.

Weight supporting portion 14 of system 10 can further include a control device 52 (as best illustrated in FIGS. 8 and 12) that is in communication with and controls the lifting mechanism control and operating system 50 and allows the user of system 10 to selectively and variably adjust one or both of the weight bearing support relief and the elevation of seat 42 by controlling lifting mechanism 28. Control device 52 can be mounted anywhere on frame portion 12, weight supporting portion 14 or other component of system 10. Control device 52 can also be configured as a remote or wireless device not physically connected to system 10. As also shown in FIGS. 8 and 12, system 10 can include multiple control devices 52 in certain embodiments of the present invention. Control device 52 can be configured to allow a user of system 10 to select the amount of body weight support or relief provided by seat 42 by adjusting the body weight support force provided by lifting mechanism 28, thereby restricting upward movement of second end 40 of lever arm 26 (and thus downward movement of seat 42 connected to first end 38 of lever arm 26) unless a downward force (i.e., body weight of the user) is applied to seat 42 that is greater than the body weight support force provided by lifting mechanism 28. For example, control device 52 can be configured to set system 10 to provide 20-pounds of body weight support or relief. Lifting mechanism 28 is set to provide 20-pounds of body weight support force to lever arm 26 (via second end 40), which in turn provides the body weight support force as an upward force to seat 42 by preventing the downward movement of seat 42 unless a downward force (i.e., the amount of the user's body weight applied to seat 42) greater than the 20-pound body weight support force is applied to seat 42.

Figure 7:
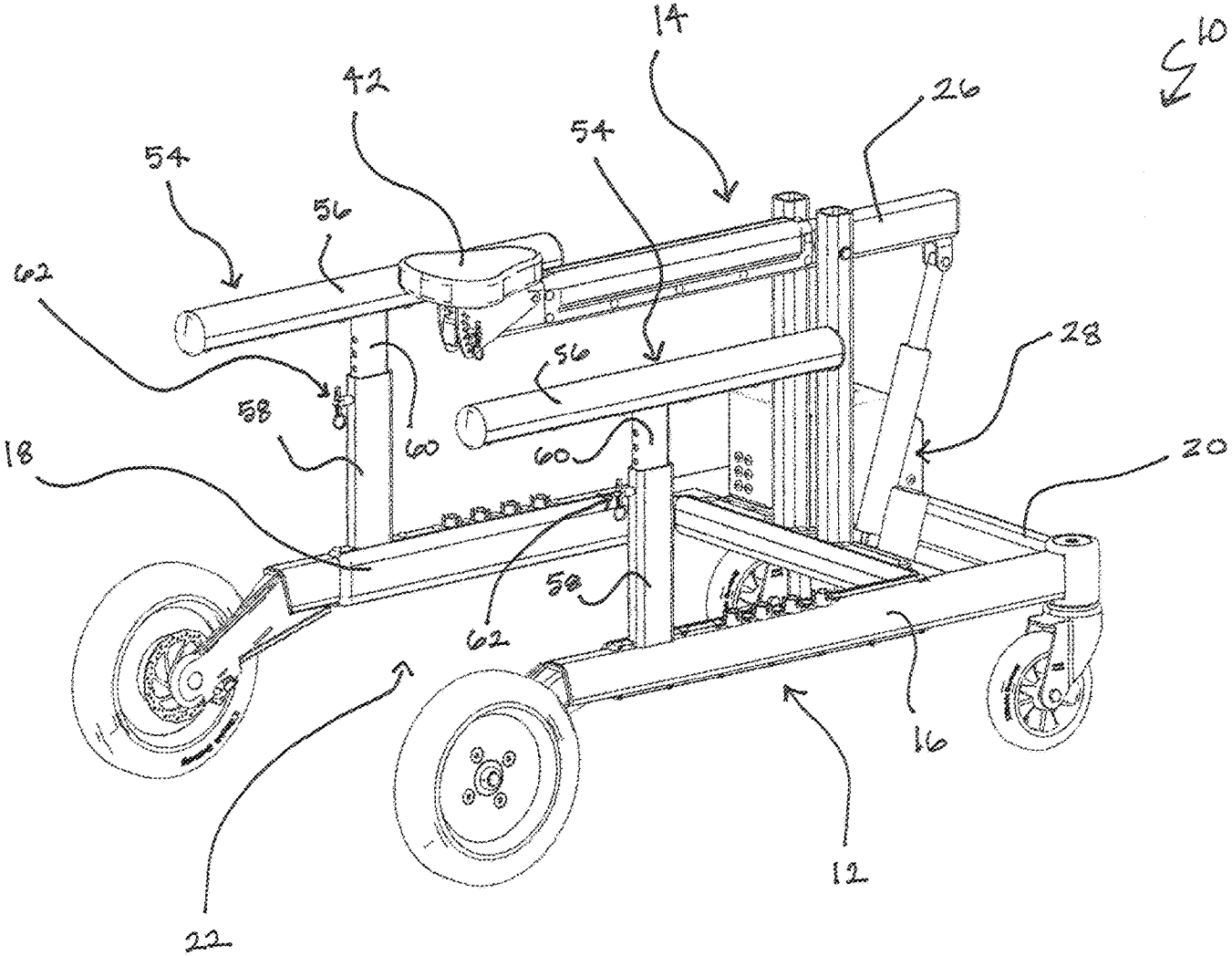
FIG. 7 is a perspective view of a supportive exercise system with side supports, leg supports and front end supports in accordance with one embodiment of the present invention.

Turning now to FIGS. 7-14, additional components of system 10 according to an exemplary embodiment of the present invention will be described in greater detail. As shown in the figures, system 10 can include frame portion 12 and weight supporting portion 14 as described above. As best shown in FIG. 7, system 10 can further include side supports 54 located on one or both sides of system 10. Side supports 54 can include a handrail 56 positioned along each side of system 10 and configured to support and/or assist a user of system 10. As best shown in FIG. 7, a first handrail 56 can extend in the longitudinal direction above first longitudinal frame member 16 and a second handrail 56 can extend in the longitudinal direction above second longitudinal frame member 18. According to the embodiments shown in FIGS. 7-14, handrails 56 are configured as elongated, generally horizontal bars extending above frame portion 12; however, it is recognized that handrails 56 can alternatively have any number of different suitable configurations in alternative embodiments of the present invention.

As best shown in FIG. 7, each handrail 56 can be connected to frame portion 12 by a handrail support member 58 extending upward from first or second longitudinal frame member 16 of 18. Each handrail 56 can further be positioned at a height above frame portion 12 that is suitable to support and assist a user of system 10 positioned on seat 42. According to certain embodiments of the present invention, as illustrated in FIGS. 7-14, the height of each handrail 56 can be selectively adjustable by the user of system 10. In such embodiments, handrail 56 can include an extension member 60 that extends downward from handrail 56 and can be received within an opening on the upper end of handrail support member 58. Handrail 56 and extension member 60 can be configured with a removable connection component that allows the depth in which extension member 60 is received within handrail support member 58 to be selectively adjusted by a user of system 10 in order to adjust the height of handrail 56. As best shown in FIGS. 7 and 12, extension member 60 can include a plurality of openings along its length that can be aligned with an opening extending through the upper end of handrail support member 58 and a locking pin connection 62 can be removably inserted through the aligned openings to secure extension member 60 and handrail support member 58 together at the desired height of handrail 56. It is also recognized that alternative connection components and means can be used in various embodiments of the present invention to selectively adjust the height of handrail 56.

As shown in FIGS. 8-14, system 10 can include leg supports 64 configured to restrict forward movement of a user's legs beyond interior region 22 of system 10. Leg supports 64 can also be configured to assist a user in preventing knee flexion during use of system 10 according to one embodiment of the present invention. As shown in FIGS. 8-14, leg supports 64 can include a leg support pad 66 positioned within interior region 22 of system 10 and above frame portion 12. Leg support pad 66 can be orientated in a general vertical direction and can have a padded surface facing open end of frame portion 12 so that the front of a user's legs face the padded surface when the user is positioned on seat 42. As also shown in FIGS. 8-14, leg support pads 66 can be secured to frame portion 12 by an extension member 68. According to certain embodiments of the present invention, extension member 68 can be adjustably secured to frame portion 12 at multiple locations along the length of first or second longitudinal frame member 16 or 18 in order to allow the position of leg supports 64 relative to seat 42 within interior region 22 to be adjusted by the user of system 10.

Figure 9:
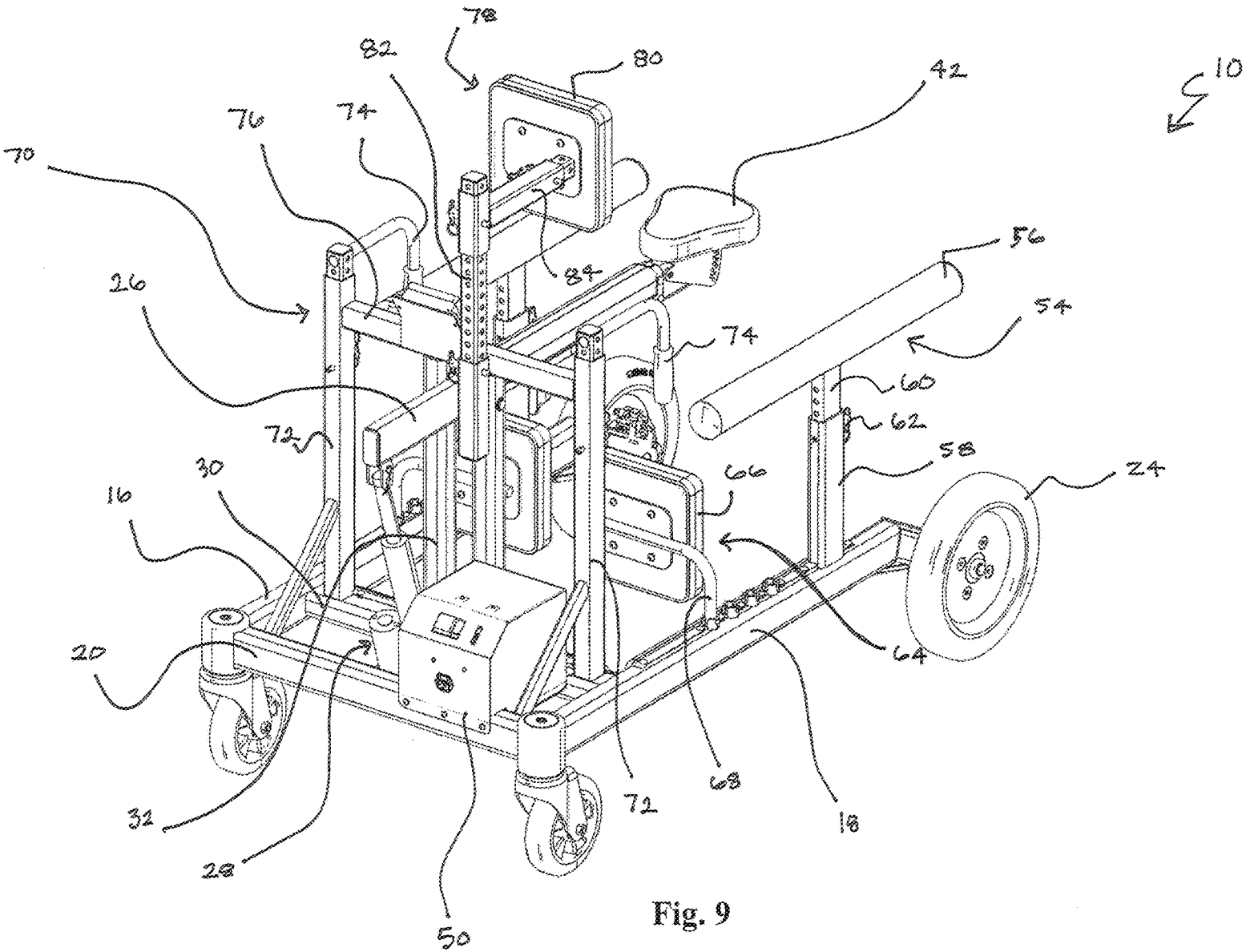
FIG. 9 is a front perspective view of the supportive exercise system of FIG. 8.
Figure 10:
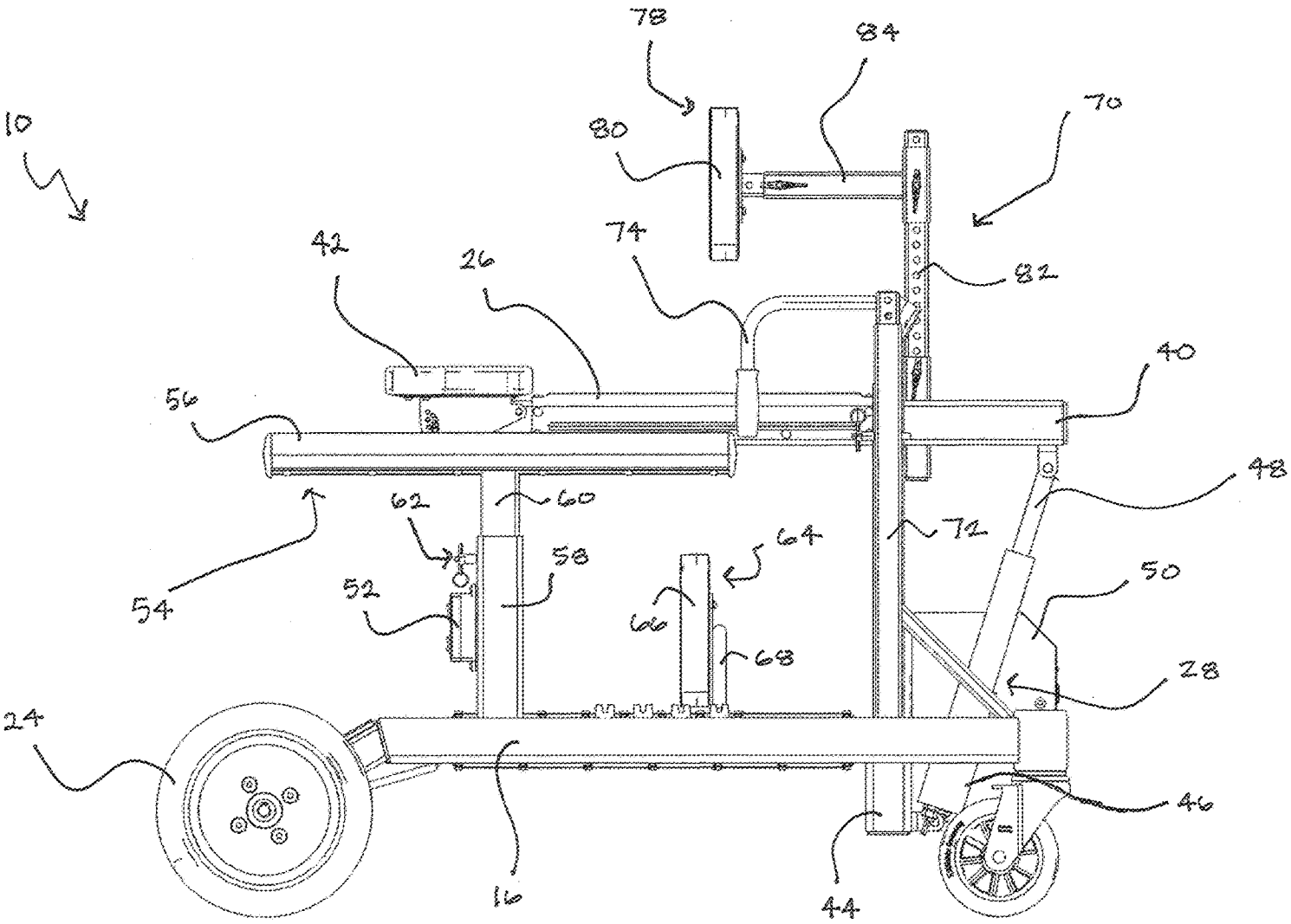
FIG. 10 is a side elevation view of the supportive exercise system of FIG. 8.
Figure 11:
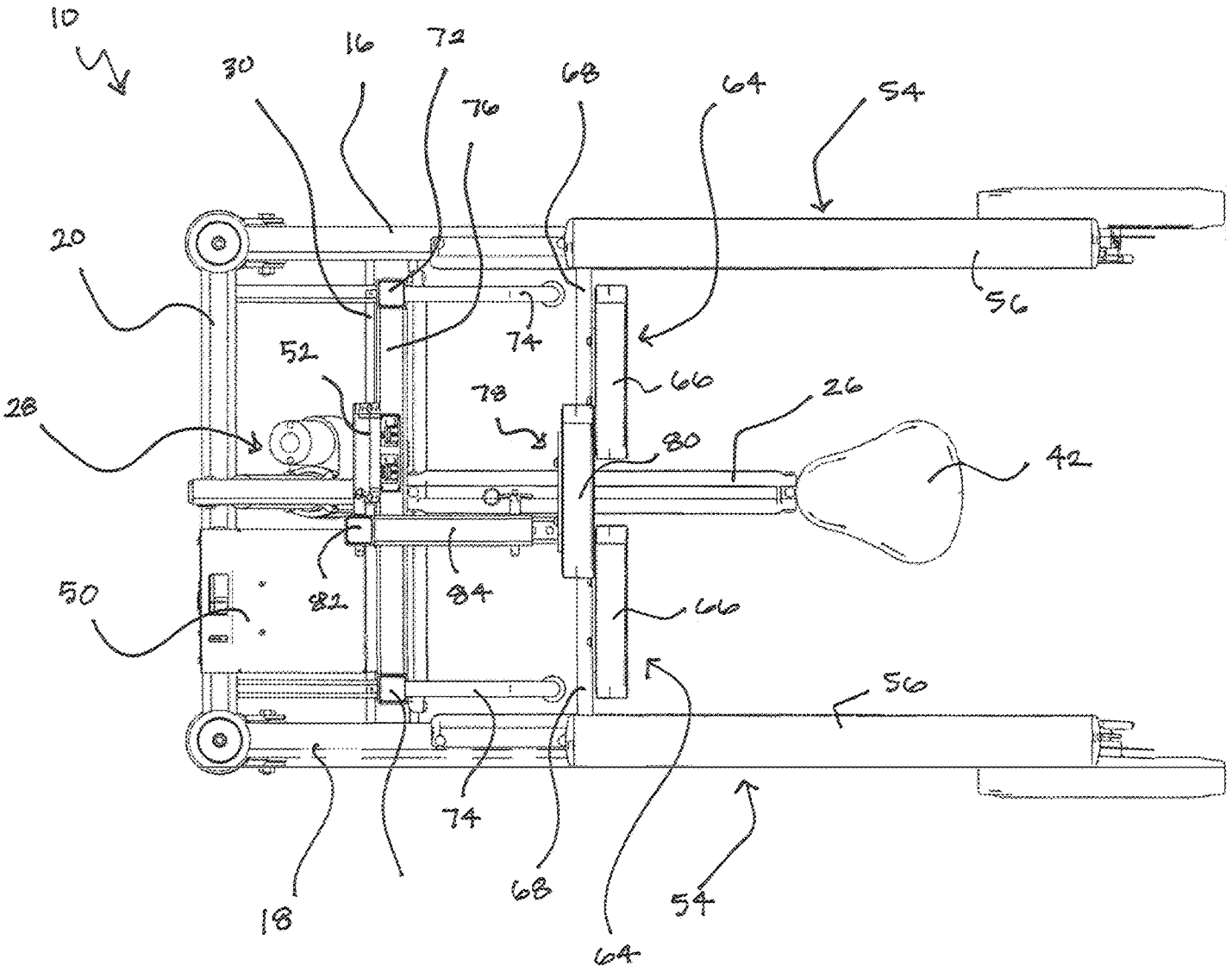
FIG. 11 is a top plan view of the supportive exercise system of FIG. 8.

As shown in FIGS. 8-14, system 10 can include a front end support frame portion 70 configured to assist a user of system 10 and prevent the user from falling forward into the components of weight supporting portion 14 of system 10. Front end support frame portion 70 can include a pair of front support column members 72 located on each longitudinal side of frame portion 12 and extending in a general vertical direction. According to one embodiment of the present invention, front support column members 72 can be connected to and extend upward from crossbar member 30 in a spaced-apart arrangement. According to another embodiment of the present invention, front support column members 72 can be connected to and extend upward from first and second longitudinal frame members 16 and 18. As best shown in FIGS. 8 and 10, each front support column member 72 can include a handle 74 connected to the upper end of the front support column member 72 and configured to assist a user when positioning themselves on seat 42 and to provide balancing support for the user when using system 10. According to certain embodiments of the present invention, handles 74 can be configured to be selectively adjustable by a user of system 10. In such embodiments, handles can include an extension arm receivable within the upper end of front support column members 72 and adjustable by a locking pin component similar to handrail 56. It is also recognized that any number of different adjustable connection components and means can be used in alternative embodiments of the present invention.

As best shown in FIGS. 8 and 9, front end support frame portion 74 can include a front crossbar member 76 extending generally horizontally between front support column members 72 and above lever arm 26. As shown in FIG. 8, control device 52 can be connected to front crossbar member 76 to allow the user to easily control system 10 and variably select the amount of weight support relief provided by seat 42 and/or the elevation of seat 42.

As best shown in FIGS. 8-10, front end support frame portion 74 can include a chest support member 78 attached to and extending from front crossbar member 76. Chest support member 78 can be configured to support the upper torso of a user of system 10 when positioned on seat 42 and prevent user from falling forward into the components of weight supporting portion 14 located at the front of system 10. As shown in FIGS. 8-10, chest support member 78 can include a vertically orientated support pad 80 facing toward seat 42 and can be connected to front crossbar member 76 by a pair of extension arms 82 and 84 that can allow for adjustment of the support pad 80 in both the vertical and horizontal directions. First extension arm 82 can be connected to crossbar member 76 and can extend upward in a vertical direction, while second extension arm 84 can be connected to first extension arm 82 at one end and chest support pad 80 at the other end and can extend in the longitudinal horizontal direction.

As best shown in FIG. 10, the height of first extension arm 82 relative to front crossbar member 76 can be selectively adjusted, such as by using a locking fastener or other suitable connection means. Second extension arm 84 can be connected to first extension arm 82 and extend generally horizontally inward toward seat 42. Support pad 80 can be connected to the end of second extension arm 84 opposite first extension arm 82. Second extension arm 84 can also include adjustable connection means to allow the height of second extension arm 84 to be adjusted relative to first extension arm 82. In addition, second extension arm 84 can include adjustable connection means to allow the extension of second extension arm 84 (and thus support pad 80) toward seat 42 to be selectively adjusted. Collectively, the adjustable connection means on first and second extension arms 82 and 84 can allow the position of chest support pad 80 relative to seat 42 to be adjusted by the user of system 10 in both the vertical and horizontal directions.

A user can use system 10 by entering the interior region 22 surrounded by the perimeter of frame portion 12 and positioning his or her body so that his or her torso is directly above seat 42. System 10 can be positioned over a static surface or any type of exercise or training equipment, such as a treadmill, as desired by the user. Using control device 52, the user can then select the desired amount of body weight support to be provided by system 10. As described above, control device 52 can operate lifting mechanism 28 and operating system 50 to adjust the force provided by lifting mechanism 28 to lever arm 26 to prevent movement of lever arm 26 (and seat 42) until the user-selected body weight support amount is exceeded by the user. After setting the body weight relief amount, the user can then engage seat 42 by lowering his or herself onto seat 42 or by lifting or lowering seat 42 via control device 52.

Exemplary Embodiment #1

System 10 according to one exemplary embodiment hereof will be described in greater detail. According to such an embodiment, system 10 can include a frame portion 12 and a weight supporting portion 14 as described above. As best shown in FIG. 1, weight supporting portion 14 can be mounted onto frame portion 12 by a support structure (described below) and can include a rotating lever arm 26 actuated by lifting mechanism 28 configured an actuator 28 in order to provide the weight support functionality of system 10. The support structure for mounting lever arm 26 to frame portion 12 can include a crossbar member 30 extending across frame portion 12 and one or more support columns 32 extending upward from crossbar member 30. As best shown in FIGS. 1 and 2, crossbar member 30 can be located within the frame perimeter and can extend between and be connected to first and second longitudinal frame members 16 and 18. According to an exemplary embodiment, crossbar member 30 can be positioned adjacent to, but spaced part from, transverse frame member 20 near the front end of frame portion 12 and interior region 22. In certain embodiments of the present invention (not shown), transverse frame member 20 can also function as crossbar member 30.

Support columns 32 can be connected to crossbar member 30 at an intermediate and/or central location of crossbar member 30 using any suitable type of fixed connection. As shown in FIGS. 1-6, support columns 32 can extend upward from crossbar member 30, and each support column 32 can terminate at an upper end 34. As also shown in FIGS. 1-6, support columns 32 can be slightly spaced apart from one another across the length of crossbar member 30 to allow lever arm 26 to pass between the two columns 32.

Lever arm 26 can be connected to support columns 32 near upper ends 34 by a pivot connection 36, such as a pin connection, that extends through both support columns 32 and lever arm 26. As best shown in FIG. 6, lever arm 26 can and can extend between both support columns 32 in the longitudinal direction and generally perpendicular to the orientation of support columns 32. As best shown in FIG. 4, pivot connection 36 can be located at an intermediate position along the length of lever arm 26 and can allow lever arm 26 to rotate about an axis that is generally perpendicular to support column 32. As further shown in FIG. 4 as well as FIG. 5, lever arm 26 can be positioned relative to frame portion 12 such that the length of lever arm 26 is generally located above frame portion 12 and at least partially within interior region 22 of system 10.

As best shown in FIG. 2, lever arm 26 can include a first end 38 and a second end 40. First end 38 can be located within a central part of interior region 22 and above frame portion 12 when lever arm 26 is extending in a generally horizontal direction. A seat 42 can be connected to first end 38 and can be configured for allowing a user of system 10 to place all or a portion of the user's body weight on seat 42 in either a sitting or standing position. According to an exemplary embodiment of the present invention, as illustrated in the FIGS. 1-6, seat 42 can be connected to first end 38 by a hinged connection that can allow seat 42 to pivot relative to lever arm 26 so that seat 42 can remain generally horizontal when lever arm 26 rotates about its pivot axis. Seat 42 can additionally have an adjustment component for allowing a user of system 10 to selectively adjust the orientation of seat 42 relative to lever arm 26.

As shown in FIGS. 1-6, and in particular FIG. 4, actuator 28 can be mounted to frame portion 12 below lever arm 26 by means of crossbar member 30 and/or transverse frame member 20. According to an exemplary embodiment, crossbar member 30 can have an extension arm 44 that extends from crossbar member 30 to connect crossbar member 30 to actuator 28. Actuator 28 can be configured as an electromechanical actuator, pneumatic actuator or hydraulic actuator and can include a lower housing or base portion 46 and an extension arm 48 receivable by and extending from base portion 46. As best shown in FIG. 4, base portion 46 can be connected to crossbar member 30 (and/or extension arm 44) and the free end of extension arm 48 can be connected to second end 40 of lever arm 26. Base portion 46 can include the motor, drive, compressor or component that extends and retracts extension arm 48 from base portion 46. According to an exemplary embodiment, the connections between extension arm 48 and lever arm second end 40 and base portion 44 and frame portion 12 are configured as pivot or pin connections that can allow actuator 28 to rotate relative to frame portion 12 and lever arm 26, and allow actuator 28 to change its angle of orientation depending on the angle of orientation of lever arm 26.

Actuator 28 can be configured to control the elevation of seat 42 by restricting the rotation of lever arm 26. Actuator 28 can restrict rotation of lever arm 26 by controlling the elevation of second end 40 of lever arm 26 via the extension arm 48. By restricting the rotation of lever arm 26, and thus the elevation of seat 42, actuator 28 can generate the desired body weight support for a user positioned on seat 42.

According to one exemplary embodiment of the present invention, actuator 28 can provide the body weight support to seat 42 in the following manner. When the length of extension arm 48 is increased as it is forced out of housing portion 44, it causes second end 40 of lever arm 26 to move upward, which in turn causes seat 42 and first end 38 of lever arm 26 to move downward. As a result, controlling the extension length of extension arm 48 can allow system 10 to control the elevation and movement of seat 42. In order to provide body weight support to a user of system 10, system 10 can be configured to control the extension of extension arm 48 from base portion 46. The extension (or retraction) of extension arm 48 can be controlled by the drive screw of actuator 28 (or the pressure of the compressed gas located within actuator 28 in the case of a pneumatic actuator). As the drive screw moves out, the extension arm 48 extends away from base portion 46. As the drive screw moves in, extension arm 48 retracts toward base portion 46. The drive screw, via the motor within base portion 46 can be configured to prevent extension of extension rod 48 unless an upward force greater than the body weight support force generated by the actuator 28 is applied to the end of extension arm 48. Because the free end of extension arm 48 is connected to second end 40 of lever arm 26, and seat 42 is connected to the opposing first end 38 of lever arm 26, a downward force applied to seat 42 transfers to an upward force pulling on the free end of extension arm 48. As a result of this configuration, a downward force (e.g., the user's body weight force) must be applied to seat 42 (that transfers along lever arm 26 to second end 40 and then to extension arm 48) that is greater than the body weight support force generated by the actuator 28 in order for the extension length of extension arm 48 to increase and cause seat 42 to move downward.

According to one exemplary embodiment, actuator 28 can be configured to (i) restrict movement of seat 42 based on a selected body weight support amount by controlling the rotation of lever arm 26 (via the extension of extension arm 48 relative to base portion 46) and (ii) selectively control the elevation of seat 42 by moving extension arm 48 to rotate lever arm 26. This can enable the user to adjust the height of seat 42 to his or her preference.

As shown in FIGS. 2-6, weight supporting portion 14 of system 10 may include an actuator control and operating system 50 configured to control the operation of actuator 28. Actuator control and operating system 50 can comprise electronic operating controls, a battery, a motor (in addition to or as an alternative to the motor in base portion 46) and/or a compressor and can be connected to actuator 28. As shown in FIGS. 2-6, actuator operating system 50 can be mounted on frame portion 12 of system 10. Actuator operating system 50 can be configured to provide power to base portion 46 in order to force or restrict the movement of extension rod 48 relative to cylinder housing 46. As described above, weight supporting portion 14 of system 10 can further include a control device 52 (as best illustrated in FIGS. 8 and 12) that controls operating system 50 and allows the user of system 10 to selectively and variably adjust one or both of the body weight support or relief amount and the elevation of seat 42 by controlling the body weight support force provided by actuator 28 in order to control the movement of extension arm 48 relative to cylinder housing 46.

Similar to as described above, a user can use system 10 by entering the interior region 22 surrounded by the perimeter of frame portion 12 and positioning his or her body so that his or her torso is directly above seat 42. Using control device 52, the user can then select the desired amount of body weight support to be provided by system 10. As described above, control device 52 can operate actuator 28 (via operating system 50) to adjust the body weight support force provided by actuator 28 to an amount that prevents extension of extension arm 48 until the user-selected body weight support amount is exceeded by the user. After setting the body weight support amount, the user can then engage seat 42 by lowering his or herself onto seat 42 or by lifting or lowering seat 42 via control device 52.

Exemplary Embodiment #2

Figure 15:
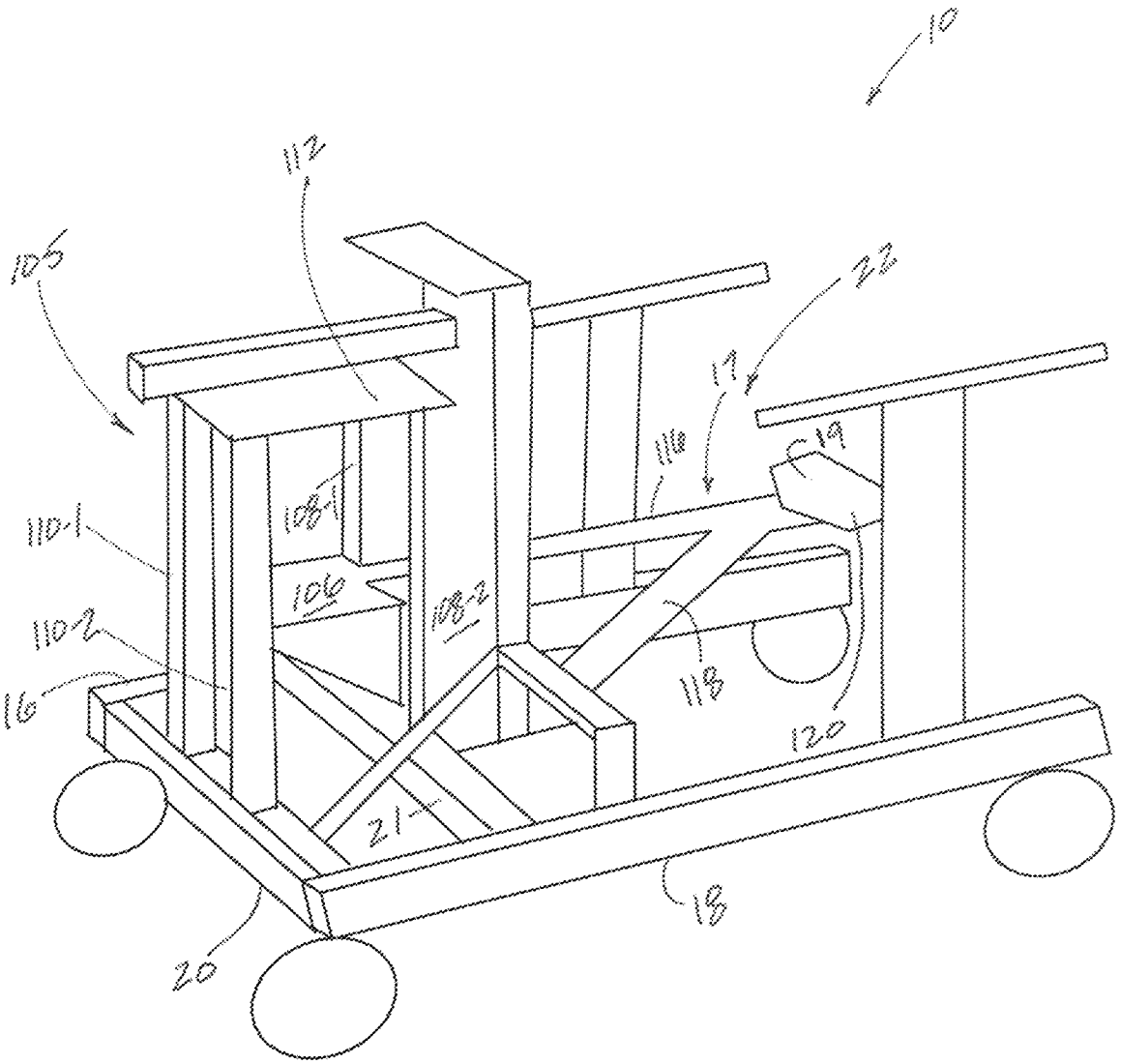
FIG. 15 shows a perspective view of an exercise support system according to exemplary embodiments herein.
Figure 10:
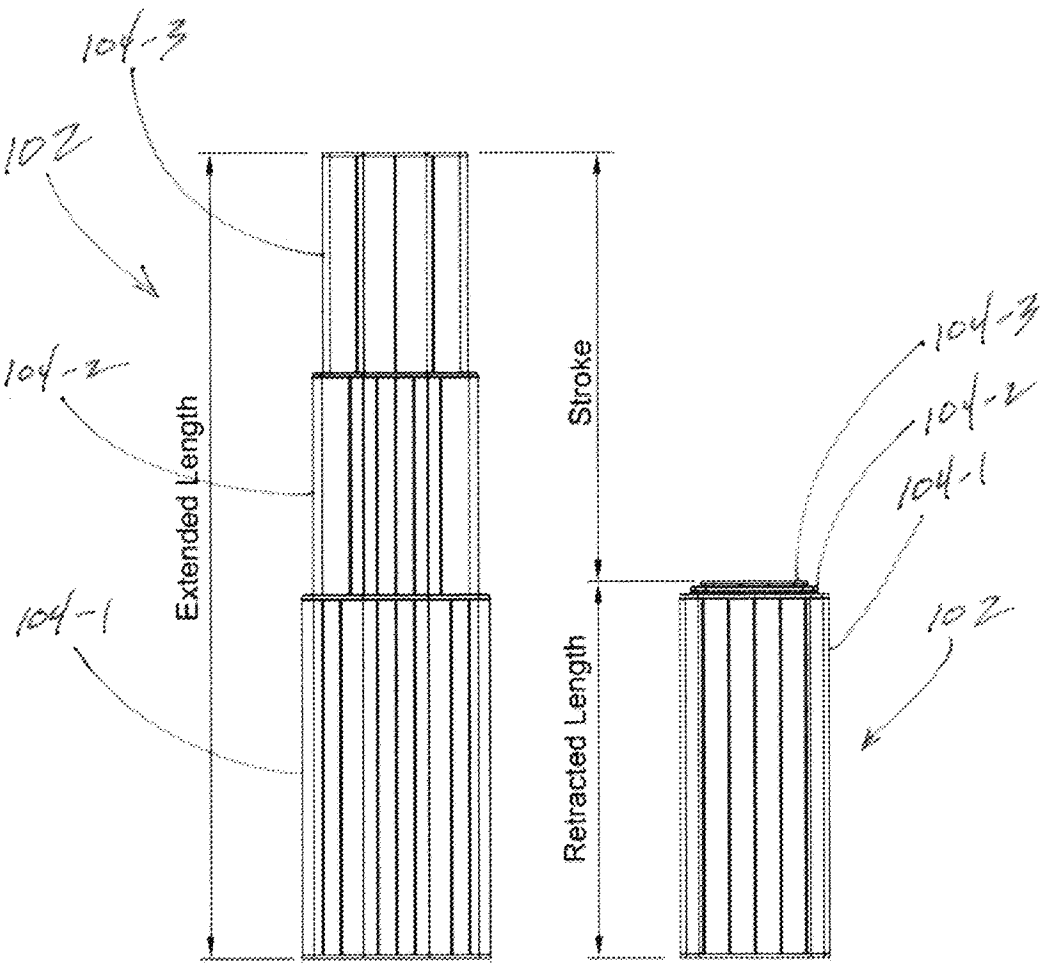

In one exemplary embodiment hereof as shown in FIG. 15, the lift assembly 13 includes a carriage and rail system 105. In one embodiment, the carriage and rail system 105 includes a carriage 106 and guide rails 108 (e.g., guide rails 108-1 and 108-2). Guide rails 108-1, 108-2 may be mounted to the frame portion 12 and configured to extend upwards. The carriage 106 may be configured with the guide rails 108-1, 108-2 and adapted to move up and down along the rails 108-1, 108-2. While FIG. 15 shows two guide rails 108-1, 108-2, the lift assembly 13 may include other numbers of guide rails 108 such as one guide rail 108, three guide rails 108 (e.g., **108-*n*) and other numbers of guide rails 108**.

In some embodiments, the frame portion 12 may include a second transverse frame member 21 (e.g., in addition to the first transverse frame member 20) extending transversely between the first and second longitudinal frame members 16, 18 at a position in from the first transverse frame member 20 (towards the interior region 22). The second transverse frame member 21 may be connected to longitudinal frame members 16 and 18 using the same or other suitable type of connection as with the first transverse frame member 20. Additional transverse frame members may also be implemented. As will be described below, the first and second transverse frame members 20, 21 may form a base for a lifting column 102 and associated elements of the lift assembly 13. The system 10 also may include other support structures mounted to or in combination with the first and second transverse frame members 20, 21 and or the longitudinal frame members 16, 18 such as a base plates, support rails, side walls, other types of support structures and any combination thereof. These structures may provide additional support to the lifting assembly 13 as necessary. As would be recognized by a person of ordinary skill in the art, these additional support structures may be mounted on top, below or in any position and/or orientation with respect to the transverse frame members 20, 21 and/or the longitudinal frame members 16, 18.

In one embodiment, the lift assembly 13 includes support members (e.g., support members 110-1 and 110-2) mounted to the top of the first transverse frame member 20 and extending upward (vertically and/or at offset angles). Optionally, the support members 110 may be configured with the first and/or second transverse frame members 20, 21 (or from any other support structures configured with the transverse frame members 20, 21 and adapted for this or other purposes) and may extend upward. While FIG. 15 shows two support members 110-1, 110-2, the lift assembly 13 may include other numbers of support members 110 such as one support member 110, three support members 110 (e.g., **110-*n*) and other numbers of support members 110**.

In one embodiment, the support members 110-1, 110-2 and the guide rails 108-1, 108-2 extend upward a generally equal distance and terminate into support plate 112. Support plate 112 may be mounted to and extend laterally from the top of the support members 110 and the guide rails 108 thereby providing lateral support to the members 110-1, 110-2 and the rails 108-1, 108-2. While the support plate 112 is depicted in FIG. 15 as generally rectangular, it is understood that the support plate 112 may be any shape and/or any combination of shapes or forms to adequately extend between the tops of the guide rails 108 and the support members 110 and to provide adequate lateral support between the rails 108 and the members 110.

In one embodiment, the carriage 106 is configured with the guide rails 108 and adapted to slidably move up and down along them. The carriage 106 may include bearings and/or other types of sliding mechanisms that may engage with the guide rails 108 to facilitate this motion. In this way, the carriage 106 may move up and down in a controlled and supported fashion as required.

In one embodiment, the drive assembly 15 may include a lifting column assembly 100. As shown in FIG. 16, the lifting column assembly 100 may include a lifting column 102 with one or more stages 104-1, 104-2, 104-3, . . . **104-*n* (collectively and individually 104). The stages 104 may be configured telescopically so that the stages 104 may extend from one another and/or retract into one another as is known in the art. Other types of stages 102 (e.g., folding) may also be used. When the stages 104 are all fully retracted, the height of the lifting column 102 is equal to the "retracted length". When the stages 104 are fully extended, the height of the lifting column is equal to the "extended length". The extended length is equal to the retracted length plus the "stroke" of the lifting column 102. The stroke is defined as the aggregate distance that the combined stages 104 may extend from the retracted length when fully extended. As is known in the art, the lifting column 102 may be controlled to extend any amount between the retracted length and the extended length. The lifting column assembly 100 may include other components and/or elements (e.g., actuators, lead screws, motors, etc.) as necessary to fulfill its functionalities. The lifting column 102** may utilize hydraulic, pneumatic, other types of actuators and/or devices and any combination thereof.

Figure 17:
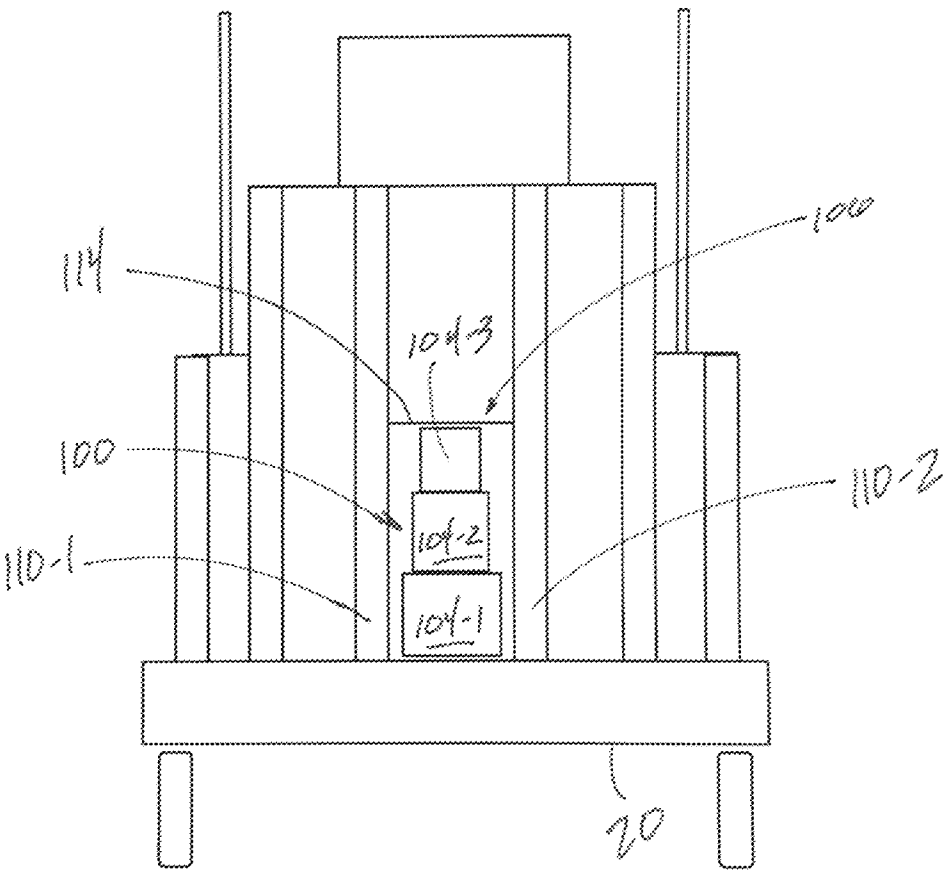
FIG. 17 shows a back view of an exercise support system according to exemplary embodiments herein.

In one embodiment as shown in FIG. 17, the carriage 106 includes a push plate 114 adapted to engage (abut against) the top of the lifting column 102. When the lifting column 102 extends, the top of the lifting column 102 (e.g., the top of the stage 104-3) may push upward on the push plate 114 thereby moving the carriage 106 upward along the guide rails 108-1, 108-2. When the lifting column 102 retracts, the push plate may follow the top of the lifting column 102 (e.g., due to gravity) and the carriage 106 may thereby move downward along the guide rails 108-1, 108-2. In this way, the extension and retraction of the lifting column 102 may lift and lower the carriage 106 accordingly.

In one embodiment, the stroke of the lifting column 102 and its stages 104 is chosen to lift the carriage 106 an adequate distance upward and to lower the carriage 106 an adequate distance downward as required by the system 10 during its use.

In one embodiment, the lift assembly 13 includes an arm assembly 17 configured with the carriage 106 and extending laterally into the area 22. In some embodiments, the arm assembly 17 includes a lateral arm member 116 and optionally a lower support member 118. In one embodiment, the lateral arm member 116 may be configured with the top portion of the carriage 106 and extend laterally into the area 22. In one embodiment, the lower support member 118 may be configured with the lower portion of the carriage 106 and extend at an upward angle to join the end of the lateral arm member 116 within the area 22. In this way, the lower support member 118 may provide vertical support to the lateral arm member 116.

In this configuration, as the lifting column 102 extends and lifts the carriage 106 upward along the guide rails 108-1, 108-2, the lateral arm member 116 is also lifted in unison with the carriage 106. And as the lifting column 102 retracts and lowers the carriage 106 along the guide rails 108-1, 108-2, the lateral arm member 116 is also lowered in unison with the carriage 106. Accordingly, the lifting column 102 provides the lifting and lowering functionalities of the lateral arm member 116.

In one embodiment, a body support 19 is configured with the end of the lateral support member 116 within the area 22. In one embodiment, the body support 19 includes a seat 120 adapted to support the user and to provide full or partial body weight support to the user via the system 10.

In one embodiment, the system 10 includes a control device 52 (see FIG. 8) adapted to control the extension and retraction of the lifting column's stages 104 and the overall height of the lifting column 102. In this way, the vertical positions of the carriage 106, the lateral arm member 116 and the seat 120 may also be controlled. In one embodiment the control device 52 is an electronic controller adapted to control the height of the lifting column 102. Other types of control devices 52 also may be used.

Exemplary Embodiment #3

Figure 18:
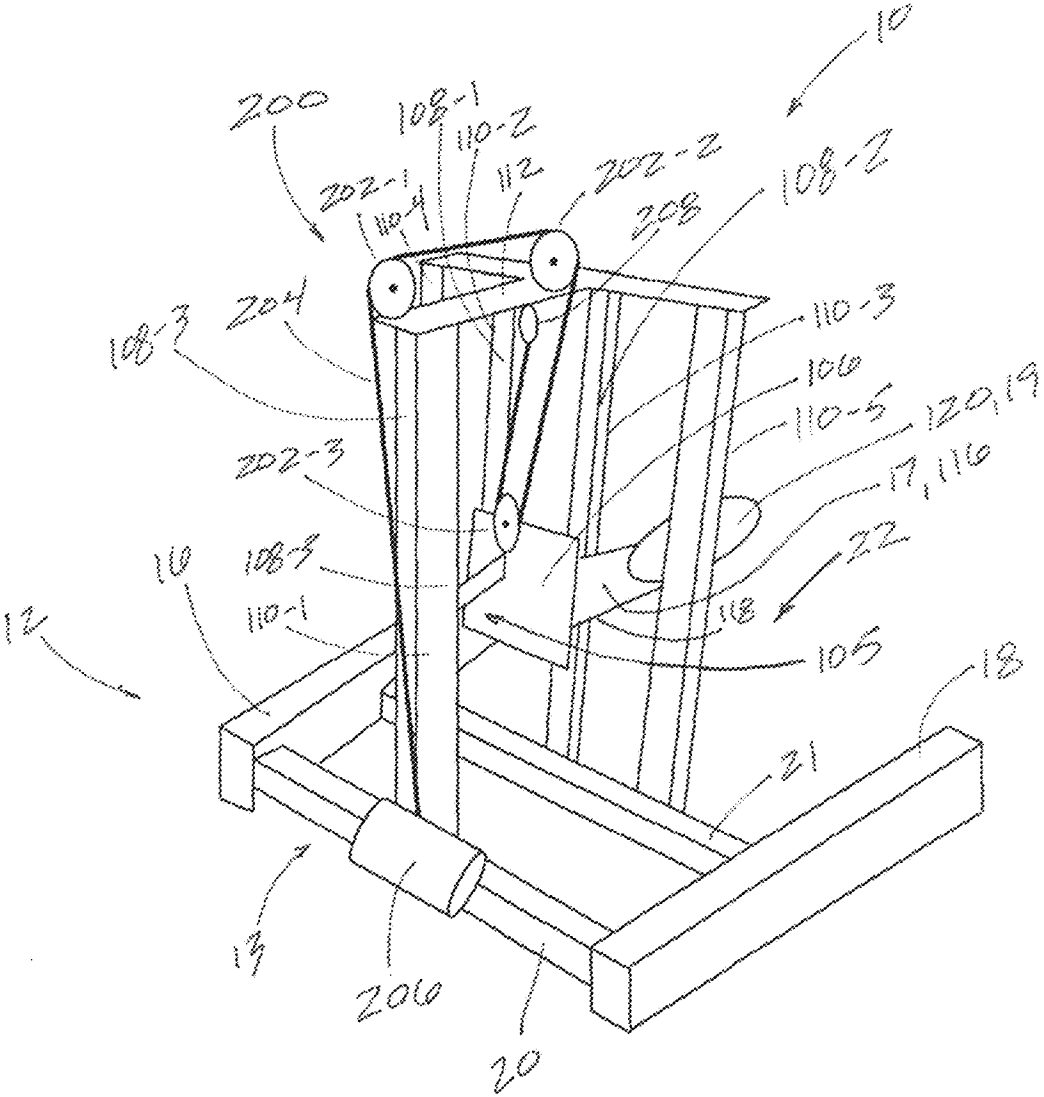
FIG. 18 shows a schematic of an exercise support system according to exemplary embodiments herein.

In one exemplary embodiment hereof as shown in FIG. 18, the lift assembly 13 may include a carriage and rail system 105 (e.g., as described above) and associated guide rails 108-1, 108-2, transverse frame members 20, 21 and other applicable elements as required.

In one embodiment, the drive assembly 15 includes a pulley assembly 200. The pulley assembly 200 may include one or more pullies 202-1, 202-2, 202-3, . . . **202-*n* (collectively and individually 202), one or more cables 204 and one or more cable extenders/retractors 206** (e.g., winch).

In one embodiment, a third support member 110-3 is mounted on the first transverse support member 20 and extends upward, and fourth and fifth support members 110-4, 110-5 are mounted on the second transverse support member 21 (e.g., on the left and right portions respectively) and extend upward. It is understood that the support members 110-3, 110-4 and 110-5 may be mounted on any portion of the frame portion 12 that may provide sufficient support. In some embodiments, the support member 110-3 also may include a guide rail 108-3. The support plate 112 may extend from the upper portion of the support member 110-3 to the upper portions of the support members 110-4, 110-5 (and optionally to the upper portions of the guide rails 108-1, 108-2), may be mounted thereto and may provide lateral support to the members 110-3, 110-4, 110-5 and rails 108-1, 108-2, 108-3.

A first pulley 202-1 is mounted at the top portion of the support member 110-3, a second pulley 202-2 is mounted on the forward end (towards the area 22) of the support plate 112 and a third pulley 202-3 is mounted on the carriage 106.

In one embodiment, the cable extender/retractor 206 is mounted to the first transverse support member 20, but it is understood that the cable extender/retractor 206 may be mounted to any adequate portion of the system 10 as necessary. In one implementation, the cable extender/retractor 206 may include a winch that may wind (to retract) and unwind (to extend) the cable 204. It is understood that other types of cable extenders/retractors 206 may also be included and/or used.

In one embodiment, a cable 202 extends from the cable extender/retractor 206 upward and around the first pulley 202-1, forward and around the second pulley 202-3, downward and around the third pulley 202-3 and upward to terminate (and mount) at the cable mount 208 (configured with the bottom portion of the support plate 112). The distal end of the cable 202 may be mounted to the cable mount 208 using any sufficient mounting techniques (e.g., clamped to a secured carabiner, mounted to a securing ring, etc.). It is understood by a person of ordinary skill in the art that the path of the cable 202 as described above is meant for demonstration and that the cable 202 may be configured in different paths that may provide the same or similar functionalities and results.

In use, the cable extender/retractor 206 may extend and/or retract lengths of the cable 204. As the cable extender/retractor 206 extends lengths of the cable 204, the length of the cable 204 between the extender/retractor 206 and the cable mount 208 may increase such that the carriage 206 is lowered along the guide rails 108. As the cable extender/retractor 206 retracts lengths of the cable 204, the length of the cable 204 between the extender/retractor 206 and the cable mount 208 may decrease such that the carriage 206 is raised along the guide rails 108. In this way, the vertical position of the carriage 206 is set by the amount of cable that the cable extender/retractor 206 may extend and/or retract.

In one embodiment, the length of cable 204 configured with the cable extender/retractor 206 is chosen to lift the carriage 106 an adequate distance upward and to lower the carriage 106 an adequate distance downward as required by the system 10 during its use.

In one embodiment, the lift assembly 13 includes an arm assembly 17 configured with the carriage 106 and extending laterally into the area 22. In some embodiments, the arm assembly 17 includes a lateral arm member 116 and optionally a lower support member 118. In one embodiment, the lateral arm member 116 may be configured with the top portion of the carriage 106 and extend laterally into the area 22. In one embodiment, the lower support member 118 may be configured with the lower portion of the carriage 106 and extend at an upward angle to join the end of the lateral arm member 116 within the area 22. In this way, the lower support member 118 may provide vertical support to the lateral arm member 116.

In this configuration, as the cable extender/retractor 106 retracts lengths of cable 204 to move the carriage 106 upward along the guide rails 108-1, 108-2, the lateral arm member 116 also is lifted in unison with the carriage 106. And as the cable extender/retractor 106 extends lengths of cable 204 and lowers the carriage 106 along the guide rails 108-1, 108-2, the lateral arm member 116 also is lowered in unison with the carriage 106. Accordingly, the cable extender/retractor 106 provides the lifting and lowering functionalities of the lateral arm member 116.

In some embodiments, the drive assembly 15 includes two or more pulley assemblies 200 adapted in combination to lift and lower the carriage 106.

In one embodiment, a body support 19 is configured with the end of the lateral support member 116 within the area 22. In one embodiment, the body support 19 includes a seat 120 adapted to support the user and to provide full or partial body weight support to the user via the system 10.

In one embodiment, the system 10 includes a control device 52 (see FIG. 8) adapted to control the cable extender/retractor 206 and the lengths of cable 204 that may be extended and/or retracted thereby. In this way, the vertical positions of the carriage 106, the lateral arm member 116 and the seat 120 may also be controlled. In one embodiment the control device 52 is an electronic controller adapted to control the cable extending and retracting of the cable extender/retractor 206. Other types of control devices 52 also may be used.

Exemplary Embodiment #4

Figure 19:
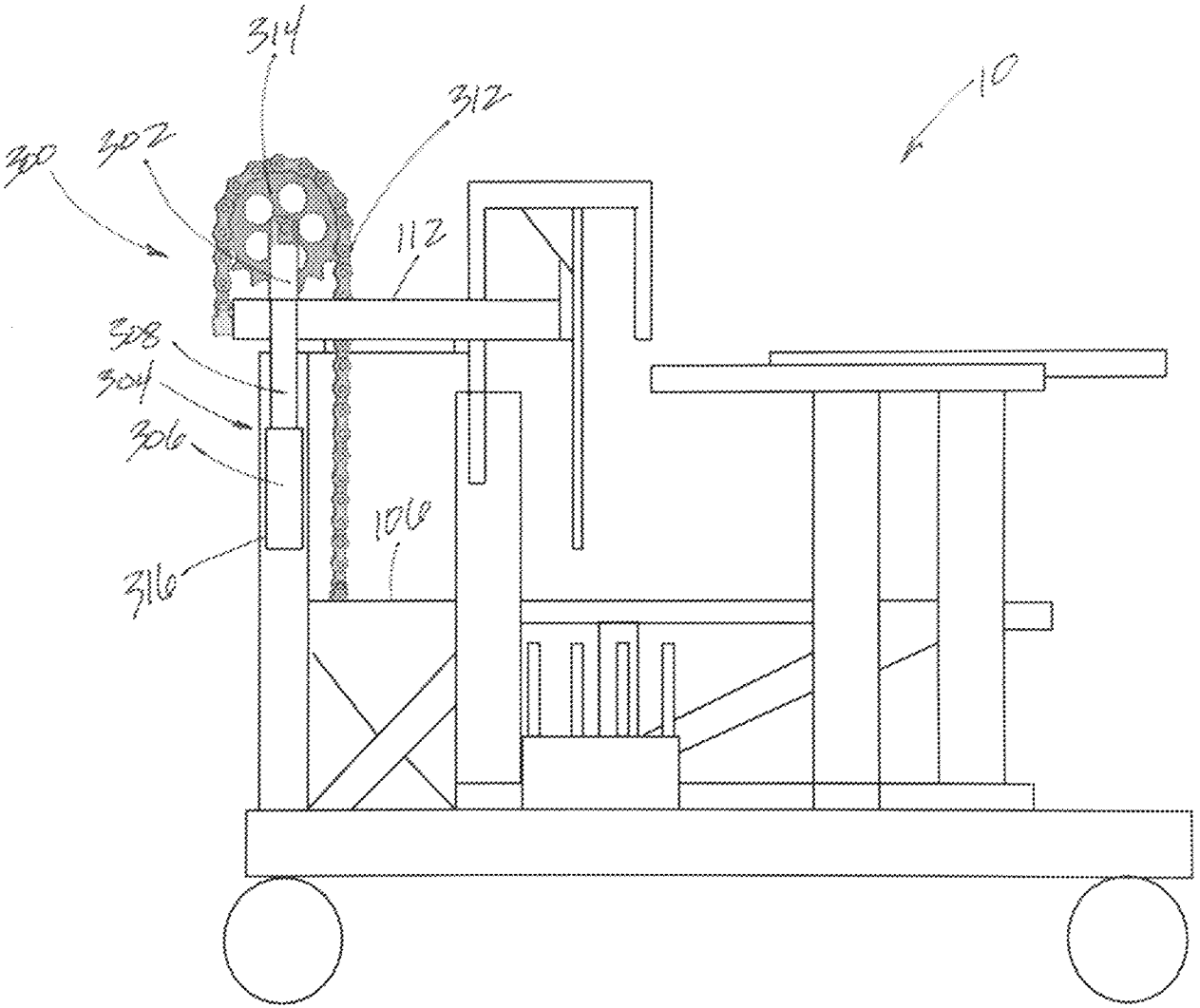
FIG. 19 shows a side view of an exercise support system according to exemplary embodiments herein.

In one exemplary embodiment hereof as shown in FIG. 19, the lift assembly 13 may include a carriage and rail system 105 (e.g., as described above) and associated guide rails 108-1, 108-2, transverse frame members 20, 21 and other applicable elements as required.

In one embodiment, the drive assembly 15 includes one or more mast assemblies 300. In one embodiment, the mast assembly 300 includes a mast 302, a hydraulic and/or pneumatic cylinder 304 (or any other type of cylinder) comprising a barrel 306 and a piston 308, and a roller chain pulley 310 assembly. The roller chain assembly 310 may include a roller chain 312 and a sprocket 314.

In one embodiment, the cylinder 304 is secured upright (preferably vertical) to a cylinder support 316 that is configured with a sufficiently stable portion of the base assembly 11 such as the longitudinal frame members 16, 18 and/or the first and second transverse frame members 20, 21. The cylinder support 316 is depicted as generally upright but may be in any adequate orientation. The cylinder's barrel 306 is oriented upwards (preferably vertically). In this configuration, the piston 308 may extend vertically from the barrel 306 when appropriately actuated and be retracted into the barrel 306. The mast 302 is configured with the upper portion of the piston 308 and extends upward (preferably vertically). The sprocket 314 is configured with the upper portion of the mast 302 and acts as the fulcrum to the roller chain pulley assembly 310. A first end of the roller chain 312 is fixedly connected to a sufficiently secure element of the system 10 (e.g., the base plate 112). The roller chain 312 extends over the sprocket 314 and its second end is fixedly connected to the carriage 106.

When extended from the barrel 306, the piston 308 moves the mast 302 upward, and because the first end of the roller chain 312 is fixedly attached to the system 10 and is thereby immobile, the upward movement of the mast 302 causes a corresponding rotation of the sprocket 314 (in this case counter-clockwise) thereby pulling the second end of the roller chain 312 upward and applying a lift to the carriage 106.

As the piston 308 is retracted into the barrel 306, the mast 302 is lowered, the sprocket rotates the opposite direction (in this case clockwise) and the second end of the roller chain 312 is lowered thereby lowering the carriage 106.

In one embodiment, the lift assembly 13 includes an arm assembly 17 configured with the carriage 106 and extending laterally into the area 22. In some embodiments, the arm assembly 17 includes a lateral arm member 116 and optionally a lower support member 118. In one embodiment, the lateral arm member 116 may be configured with the top portion of the carriage 106 and extend laterally into the area 22. In one embodiment, the lower support member 118 may be configured with the lower portion of the carriage 106 and extend at an upward angle to join the end of the lateral arm member 116 within the area 22. In this way, the lower support member 118 may provide vertical support to the lateral arm member 116.

In this configuration, as the mast assembly 300 moves the carriage 106 upward along the guide rails 108-1, 108-2, the lateral arm member 116 also is lifted in unison with the carriage 106. And as the mast assembly 300 lowers the carriage 106 along the guide rails 108-1, 108-2, the lateral arm member 116 also is lowered in unison with the carriage 106. Accordingly, the mast assembly 300 provides the lifting and lowering functionalities of the lateral arm member 116.

In some embodiments, the mast assembly 300 may include one stage, two stages, three stages and/or any number of stages necessary to lift and lower the carriage 106 a distance sufficient for the use of the system 10.

In some embodiments, the drive assembly 15 includes two or more mast assemblies 300 adapted in combination to lift and lower the carriage 106.

In one embodiment, a body support 19 is configured with the end of the lateral support member 116 within the area 22. In one embodiment, the body support 19 includes a seat 120 adapted to support the user and to provide full or partial body weight support to the user via the system 10.

In one embodiment, the system 10 includes a control device 52 (see FIG. 8) adapted to control the extension and/or retraction of the piston 308 and the raising and/or lowering of the mast 302. In this way, the vertical positions of the carriage 106, the lateral arm member 116 and the seat 120 may also be controlled. In one embodiment the control device 52 is an electronic controller adapted to control the cylinder 304. Other types of control devices 52 also may be used.

Exemplary Embodiment #5

Figure 20:
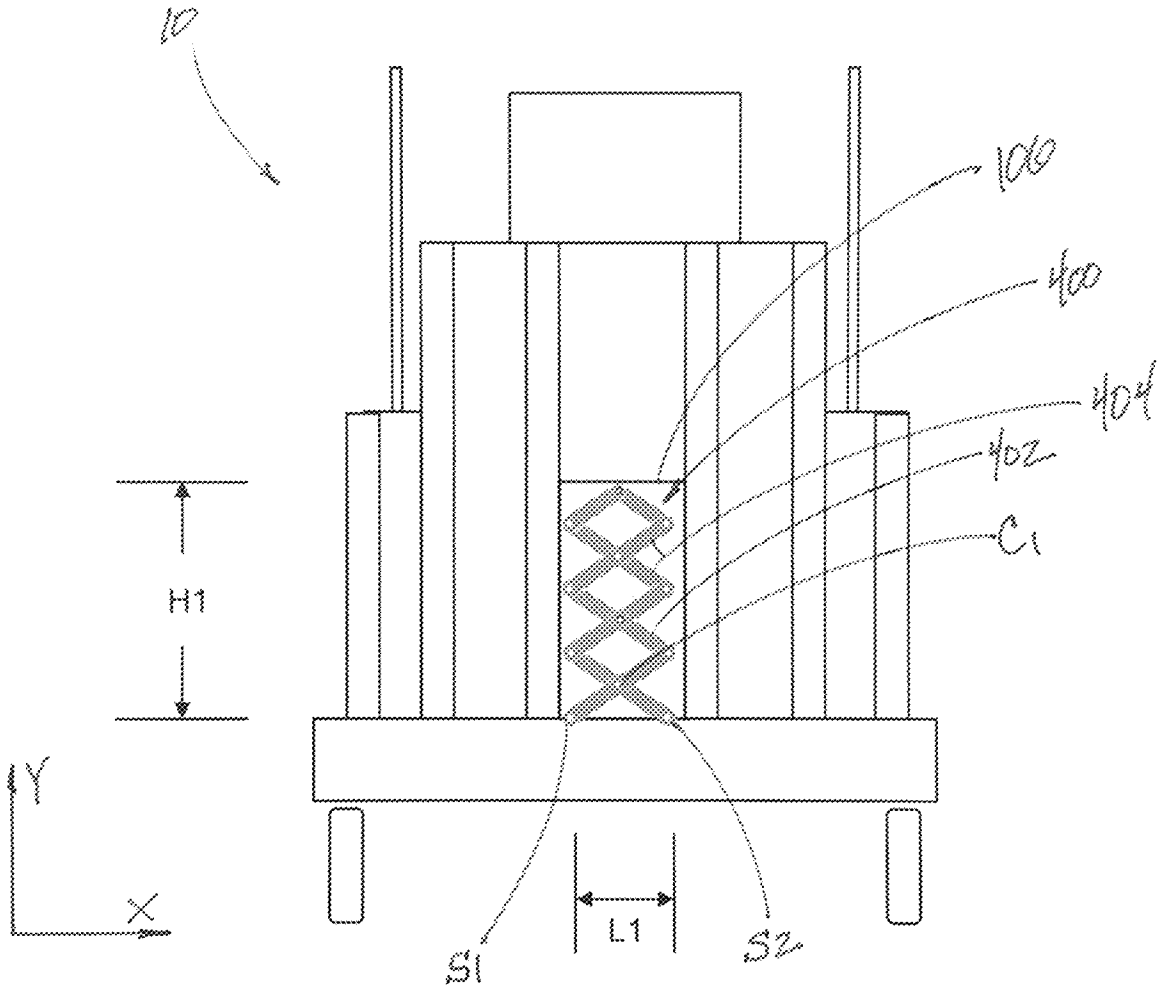
FIG. 20 shows a back view of an exercise support system according to exemplary embodiments herein.

In one exemplary embodiment hereof as shown in FIG. 20, the drive assembly 15 may include a scissor lift assembly 400. In one embodiment, the scissor lift assembly 400 replaces the lifting column assembly 100.

In one preferred implementation, the scissor lift assembly 400 may include one or more pantographs 402. As is shown, a pantograph 402 may include a series of linked parallelograms that may include opposing line segments 404 with hinged intersections. It may be preferable that the line segments 404 be of equal length such that geometric changes may be uniform across the assembly 400. In this way, the assembly 400 may provide a true vertical lift.

As shown in the figure, the length L1 represents the horizontal distance between the two opposing outer hinged intersections S1, S2. As the length L1 may decrease along the X-axis, the height H1 of the scissor lift assembly 100 may increase along the Y-axis. And as L1 may then increase along the X-axis, the height H1 of the scissor lift assembly 400 may decrease along the Y-axis. In both types of movements, the height of the pantograph 402 may extend and/or shorten while maintaining the integrity of its geometric figure.

In a first preferred implementation, the elongation and shortening of the scissor lift assembly 400 may be affected by a force applied to the opposing outer hinged intersections S1, S2 along the X-axis. For example, a force F1 that may tend to separate the hinged intersections S1, S2 along the X-axis may cause the height of the pantograph 102 to decrease along the Y-axis. Conversely, a force F2 that may tend to separate the hinged intersections S1, S2 along the X-axis may cause the height of the pantograph 102 to increase along the Y-axis. In one implementation, the forces may be applied to both hinged intersections S1, S2. In one implementation, the forces may be applied to one of the hinged intersections S1, S2 and the other hinged intersection S2, S1 may be immobilized (e.g., fixedly attached to the system 10).

In a second preferred implementation, the elongation and shortening of the scissor lift assembly 400 may be affected by a force applied to one or more center pins C1 with one bottom hinged intersection S1, S2 immobilized (e.g., fixedly attached to the system 10). Because the center pin C1 may move vertically as the force(s) are applied, the mechanism applying the force may preferably be free to also move vertically as necessary.

In a third implementation, the force(s) are applied at an angle to the inner region of one or more line segments 404.

The forces may be applied by pneumatic or hydraulic actuators, or a mechanical input such as a leadscrew or rack and pinion drive.

A person of ordinary skill in the art will understand, upon reading this specification, that the various types of lift assemblies 13 and/or drive assemblies 15 are meant for demonstration and that the system 10 may utilized other types of lift assemblies 13 and/or drive assemblies 15 as known in the art (whether described herein or otherwise). It is also understood that the scope of the system 10 is not limited in any way by the type or types of lift assemblies 13 and/or drive assemblies 15 implemented.

Additional Information and Accessories

Figure 21:
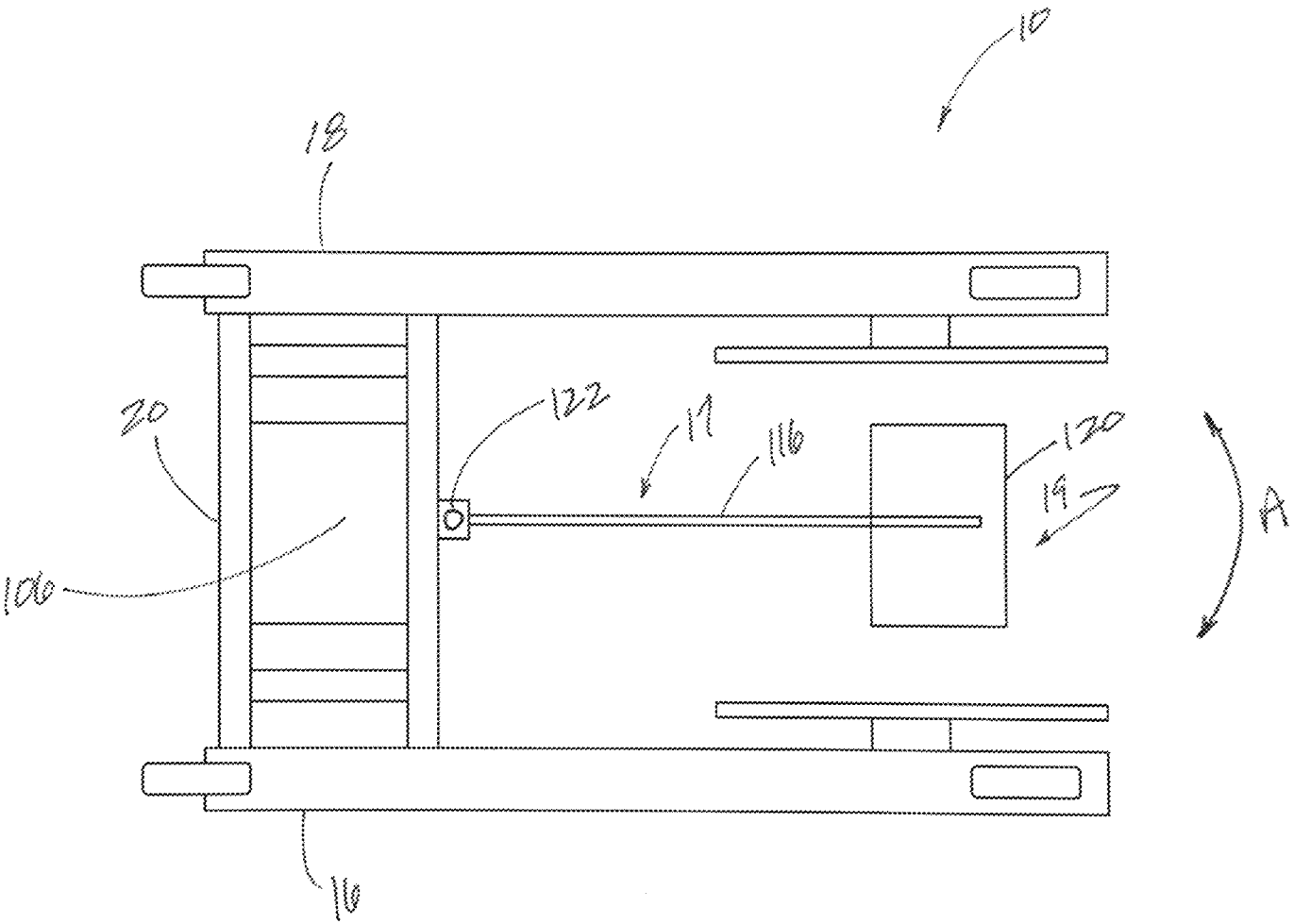
FIG. 21 shows a bottom view of an exercise support system according to exemplary embodiments herein.

In one exemplary embodiment hereof as shown in FIG. 21, the arm assembly 17 (including the body support 19) may be configured with the drive assembly 15 (e.g., the carriage 106 using a swivel mount 122. The swivel mount 122 may comprise any type of mechanism that allows for side-to-side movement in two and/or three dimensions (e.g., a rod that may swivel within a support structure, a ball joint, etc.). In this way, the arm assembly 17 may swivel from side-to-side to provide flexibility and comfort to a person engaged with the body support 19 (e.g., the seat 120 of FIG. 15). This side-by-side motion is depicted by arrow A in FIG. 21.

In some embodiments, the arm assembly 17 in combination with the swivel mount 122 includes a left and/or right stop to inhibit the arm assembly 17 from swiveling on either side beyond the point of the stop. This allows the user to set the arc of motion that the arm assembly 17, and therefor the body support 19, may travel. In some embodiments, the position of the stop(s) is adjustable and lockable by moveable pins, latches or other position adjustment and locking mechanisms. In some embodiments, the allowed arc of motion may include about +/−15° from the center position but any allowed arc of motion may be set and used.

Figure 22:
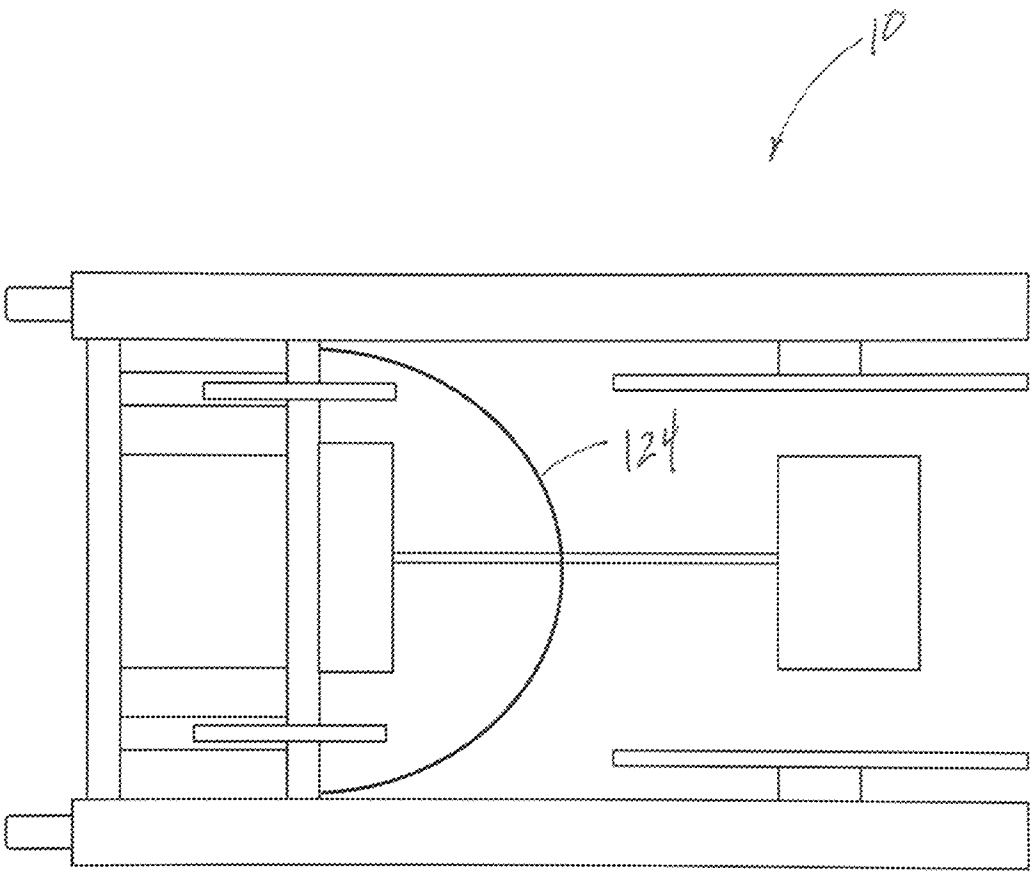
FIG. 22 shows a top view of an exercise support system according to exemplary embodiments herein.

In one exemplary embodiment hereof as shown in FIG. 22, the system 10 includes a support belt 124 that may be adapted to pass around the mid-section of the user and provide support to the user (e.g., while the user is in a standing position, performing walking exercises, etc.). The belt 124 may comprise a strip of any suitable material or combinations of materials such as leather, nylon, polyester or other materials as well as padding as required. The width of the belt 124 may range from one inch to six or more inches depending on the application of the belt 124.

In some embodiments, the left and right ends of the belt 124 are attached to any suitable left and right structures of the system 10, respectively, approximately at waist level of the user. For example, a first end of the belt 124 may be attached to a first guide rail 108-1 and a second end of the belt may be attached to a second guide rail 108-2. In some embodiments, the length of the belt 124 between the first end and the second end may be adjustable so that the length and the positioning of the belt 124 is customizable to the user. The belt may then generally pass around the gluteus maximus of the user and provide support to his/her hips. In this way, the user's hips may be supported in a generally upright and/or forward position.

Figure 23:
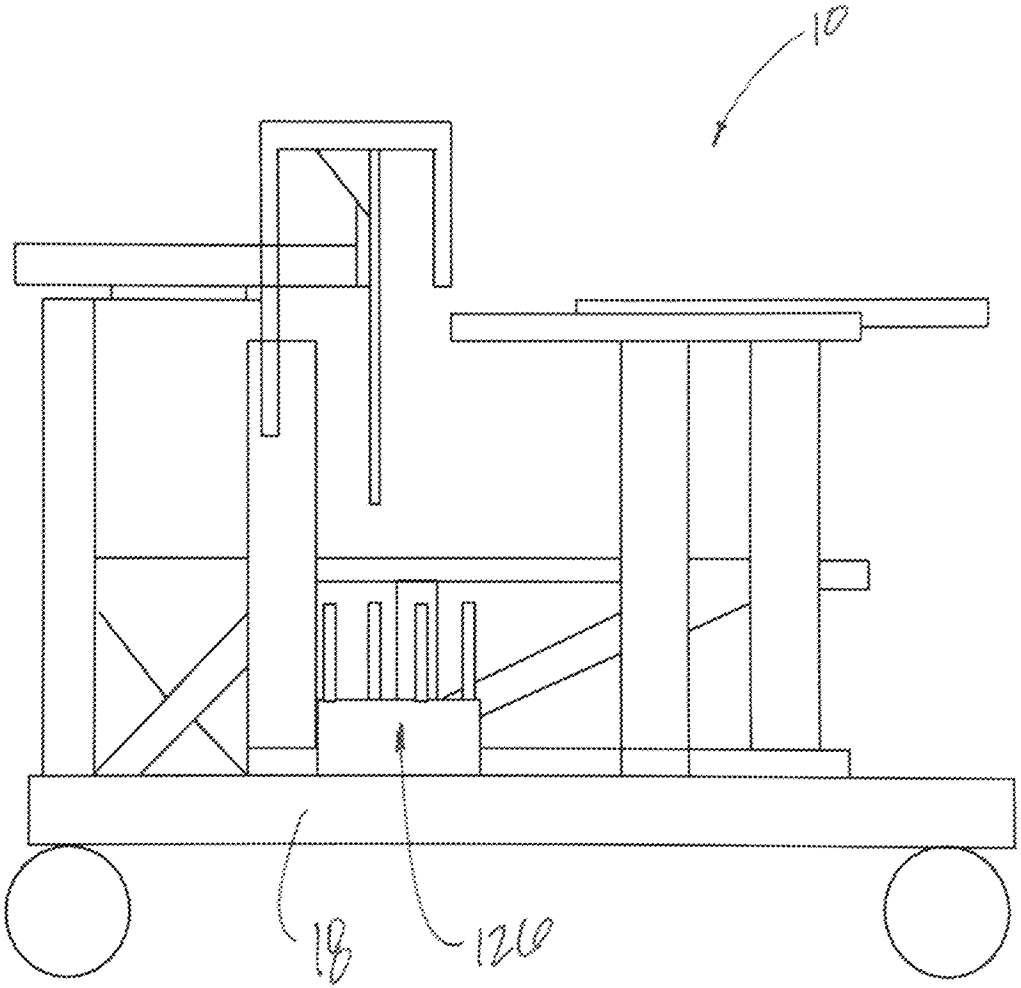
FIG. 23 shows a side view of an exercise support system according to exemplary embodiments herein.

In one exemplary embodiment hereof, the system 10 includes left and/or right foot supports 126 for use by an assistant (e.g., physical therapist) to the user of the system 10. For example, for some exercises, the user of the system 10 may stand upright within the inner area 22 and facing the system 10 (with or without bodily support from the arm assembly 17 and body support 19), and an assistance may sit behind the user with his/her left and right legs on either side of the user (e.g., with his/her left leg positioned to the left of the user and his/her right leg positioned to the right of the user). In this position, it may be beneficial to provide left and right foot supports 126 to the assistant as shown in FIG. 23. In one embodiment, the left foot support 126 may be configured with support structure 18 (as shown) and the right support structure 126 may be configured with support structure 16. The foot supports 126 may comprise a base with upward extending posts or other types of structures upon which the assistant may position his/her foot against for support. The foot supports 126 may include any number of upward extending posts that the assistant may choose from depending on the position of the assistant in relation to the system 10.

It is also understood that any elements, components, mechanisms and/or functional details described in relation to or in association with any particular embodiment(s) and/or elements of the system 10 herein also may or may not be applied to any other embodiments and/or elements related to or in association with the system 10.

From the foregoing, it will be seen that this invention is one well adapted to attain all the ends and objects hereinabove set forth together with other advantages which are obvious, and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

Those of ordinary skill in the art will appreciate and understand, upon reading this description, that embodiments hereof may provide different and/or other advantages, and that not all embodiments or implementations need have all advantages.

Where a process is described herein, those of ordinary skill in the art will appreciate that the process may operate without any user intervention. In another embodiment, the process includes some human intervention (e.g., a step is performed by or with the assistance of a human).

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs," means "two or more ABCs," and includes "two ABCs." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent or similar purpose can replace features disclosed in the specification, unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

I claim:

1. A body support exercise system comprising:

a frame portion;

at least one upright rail coupled with the frame portion;

a carriage coupled with the at least one upright rail and adapted to move along the at least one upright rail;

a movement mechanism coupled with the carriage and adapted to apply an upward and/or downward force to the carriage;

an elongated member with a proximal end and a distal end, the proximal end coupled with the carriage;

a body support member coupled with the distal end of the elongated member;

wherein the movement mechanism applies an upward force to the carriage to move the carriage and the body support member upward.

2. The body support exercise system of claim 1 wherein the upward force moves the carriage and the body support member upward to a first fixed position.

3. The body support exercise system of claim 1 wherein the movement mechanism is selected from the group: a lifting column, a pulley assembly, a mast assembly and a scissor lift assembly.

4. The body support exercise system of claim 1 wherein the frame portion defines a frame perimeter and the body support member is positioned within the frame perimeter.

5. The body support exercise system of claim 1 wherein the body support member includes a seat adapted to support a user of the body support system.

6. The body support exercise system of claim 5 further comprising a belt assembly adaptable to hold the user of the body support system in the proper position with respect to the seat.

7. The body support exercise system of claim 5 further comprising at least one foot support member coupled with the frame portion and adaptable to support a foot of a person assisting the user of the body support system.

8. The body support exercise system of claim 1 wherein the proximal end of the elongated member is coupled with the carriage using a swivel mechanism enabling the body support member to swivel from side to side.

9. A body support exercise system comprising:

a frame portion;

at least one upright rail coupled with the frame portion;

a carriage coupled with the at least one upright rail and adapted to move along the at least one upright rail from a first position to a second position;

a movement mechanism coupled with the carriage and adapted to move the carriage from the first position to the second position and to subsequently hold the carriage at the second position;

an elongated member with a proximal end and a distal end, the proximal end coupled with the carriage;

a body support member coupled with the distal end of the elongated member;

wherein the movement mechanism moves the carriage from the first position to the second position and subsequently holds the carriage at the second position, thereby moving the body support member and holding the body support member at the second position.

10. The body support exercise system of claim 9 where in the movement mechanism is selected from the group: a lifting column, a pulley assembly, a mast assembly and a scissor lift assembly.

11. The body support exercise system of claim 9 wherein the frame portion defines a frame perimeter and the body support member is positioned within the frame perimeter.

12. The body support exercise system of claim 9 wherein the body support member includes a seat adapted to support a user of the body support system.

13. The body support exercise system of claim 12 further comprising a belt assembly adaptable to hold the user of the body support system in the proper position with respect to the seat.

14. The body support exercise system of claim 12 further comprising at least one foot support member coupled with the frame portion and adaptable to support a foot of a person assisting the user of the body support system.

15. The body support exercise system of claim 9 wherein the proximal end of the elongated member is configured with the carriage using a swivel mechanism enabling the body support member to swivel from side to side.

* * * * *